US010035367B1

(12) United States Patent
Yap et al.

(10) Patent No.: US 10,035,367 B1
(45) Date of Patent: Jul. 31, 2018

(54) SINGLE MOTOR DYNAMIC RIBBON FEEDBACK SYSTEM FOR A PRINTER

(71) Applicant: Datamax-O'Neil Corporation, Orlando, FL (US)

(72) Inventors: Yaw Horng Yap, Singapore (SG); Chin Young Wong, Singapore (SG); Ching Hong Chua, Sinapore (SG)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 15/629,050

(22) Filed: Jun. 21, 2017

(51) Int. Cl.

| | |
|---|---|
| ***B41J 29/393*** | (2006.01) |
| ***B41J 33/24*** | (2006.01) |
| ***B41J 33/34*** | (2006.01) |
| ***B41J 33/22*** | (2006.01) |
| ***B41J 2/325*** | (2006.01) |
| *B41J 17/08* | (2006.01) |

(52) U.S. Cl.
CPC ..... *B41J 33/34* (2013.01); *B41J 2/325* (2013.01); *B41J 33/22* (2013.01); *B41J 33/24* (2013.01); *B41J 17/08* (2013.01)

(58) Field of Classification Search
CPC ... B41J 33/34; B41J 2/325; B41J 33/32; B41J 33/24
See application file for complete search history.

(56) References Cited

U.S. PATENT DOCUMENTS 5,657,066 A * 8/1997 Adams ..... B41J 2/325 347/198
6,034,708 A 3/2000 Adams et al.
6,082,914 A * 7/2000 Barrus ..... B41J 2/325 400/223

(Continued)

FOREIGN PATENT DOCUMENTS

JP 2002254784 A 9/2002
WO 2013163789 A1 11/2013

(Continued)

OTHER PUBLICATIONS

U.S. Appl. No. 13/367,978, filed Feb. 7, 2012, (Feng et al.); now abandoned.

(Continued)

*Primary Examiner* — Lamson Nguyen
(74) *Attorney, Agent, or Firm* — Additon, Higgins & Pendleton, P.A.

(57) ABSTRACT

A printer with a single motor system to match torques between ribbon supply and ribbon take-up is provided. The printer comprises a ribbon supply spindle, a take-up ribbon spindle, sensors to output ribbon width and diameter at ribbon supply, and a sensor which outputs ribbon diameter at ribbon take-up. The printer is provided with a drive system providing rotation to the ribbon supply via tension on the ribbon loaded on the ribbon supply spindle and taken-up on the take-up ribbon spindle. Firmware, communicatively linked to the sensors and the drive system, is configured to (Continued)

calculate ribbon tension at the ribbon supply spindle, to calculate the torque required on the ribbon on the ribbon take-up spindle to match the ribbon tension at the take-up spindle to the ribbon tension at the ribbon supply spindle, and to adjust the drive system to match these torques.

20 Claims, 7 Drawing Sheets

(56) References Cited

U.S. PATENT DOCUMENTS 6,832,725 B2 12/2004 Gardiner et al.
6,840,689 B2 * 1/2005 Barrus ..... B41J 2/325 400/234
7,128,266 B2 10/2006 Zhu et al.
7,159,783 B2 1/2007 Walczyk et al.
7,413,127 B2 8/2008 Ehrhart et al.
7,726,575 B2 6/2010 Wang et al.
8,294,969 B2 10/2012 Plesko
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,730,287 B2 5/2014 Bouverie et al.
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.

(56) References Cited

U.S. PATENT DOCUMENTS 8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.
8,978,984 B2 3/2015 Hennick et al.
8,985,456 B2 3/2015 Zhu et al.
8,985,457 B2 3/2015 Soule et al.
8,985,459 B2 3/2015 Kearney et al.
8,985,461 B2 3/2015 Gelay et al.
8,988,578 B2 3/2015 Showering
8,988,590 B2 3/2015 Gillet et al.
8,991,704 B2 3/2015 Hopper et al.
8,996,194 B2 3/2015 Davis et al.
8,996,384 B2 3/2015 Funyak et al.
8,998,091 B2 4/2015 Edmonds et al.
9,002,641 B2 4/2015 Showering
9,007,368 B2 4/2015 Laffargue et al.
9,010,641 B2 4/2015 Qu et al.
9,015,513 B2 4/2015 Murawski et al.
9,016,576 B2 4/2015 Brady et al.
D730,357 S 5/2015 Fitch et al.
9,022,288 B2 5/2015 Nahill et al.
9,030,964 B2 5/2015 Essinger et al.
9,033,240 B2 5/2015 Smith et al.
9,033,242 B2 5/2015 Gillet et al.
9,036,054 B2 5/2015 Koziol et al.
9,037,344 B2 5/2015 Chamberlin
9,038,911 B2 5/2015 Xian et al.
9,038,915 B2 5/2015 Smith
D730,901 S 6/2015 Oberpriller et al.
D730,902 S 6/2015 Fitch et al.
D733,112 S 6/2015 Chaney et al.
9,047,098 B2 6/2015 Barten
9,047,359 B2 6/2015 Caballero et al.
9,047,420 B2 6/2015 Caballero
9,047,525 B2 6/2015 Barber
9,047,531 B2 6/2015 Showering et al.
9,049,640 B2 6/2015 Wang et al.
9,053,055 B2 6/2015 Caballero
9,053,378 B1 6/2015 Hou et al.
9,053,380 B2 6/2015 Xian et al.
9,057,641 B2 6/2015 Amundsen et al.
9,058,526 B2 6/2015 Powilleit
9,064,165 B2 6/2015 Havens et al.
9,064,167 B2 6/2015 Xian et al.
9,064,168 B2 6/2015 Todeschini et al.
9,064,254 B2 6/2015 Todeschini et al.
9,066,032 B2 6/2015 Wang
9,070,032 B2 6/2015 Corcoran
D734,339 S 7/2015 Zhou et al.
D734,751 S 7/2015 Oberpriller et al.
9,082,023 B2 7/2015 Feng et al.
9,224,022 B2 12/2015 Ackley et al.
9,224,027 B2 12/2015 Van Horn et al.
D747,321 S 1/2016 London et al.
9,230,140 B1 1/2016 Ackley
9,443,123 B2 1/2016 Hejl
9,250,712 B1 2/2016 Todeschini
9,258,033 B2 2/2016 Showering
9,262,633 B1 2/2016 Todeschini et al.
9,310,609 B2 4/2016 Rueblinger et al.
D757,009 S 5/2016 Oberpriller et al.
9,342,724 B2 5/2016 McCloskey
9,375,945 B1 6/2016 Bowles
D760,719 S 7/2016 Zhou et al.
9,390,596 B1 7/2016 Todeschini
D762,604 S 8/2016 Fitch et al.
D762,647 S 8/2016 Fitch et al.
9,412,242 B2 8/2016 Van Horn et al.
D766,244 S 9/2016 Zhou et al.
9,443,222 B2 9/2016 Singel et al.
9,478,113 B2 10/2016 Xie et al.
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0287258 A1 10/2013 Kearney
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0313325 A1 11/2013 Wilz et al.
2013/0342717 A1 12/2013 Havens et al.
2014/0001267 A1 1/2014 Giordano et al.
2014/0002828 A1 1/2014 Laffargue et al.
2014/0008439 A1 1/2014 Wang
2014/0025584 A1 1/2014 Liu et al.
2014/0100813 A1 1/2014 Showering
2014/0034734 A1 2/2014 Sauerwein
2014/0036848 A1 2/2014 Pease et al.
2014/0039693 A1 2/2014 Havens et al.
2014/0042814 A1 2/2014 Kather et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078341 A1 3/2014 Havens et al.
2014/0078342 A1 3/2014 Li et al.
2014/0078345 A1 3/2014 Showering
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.

(56) References Cited

U.S. PATENT DOCUMENTS

2014/0104451 A1 4/2014 Todeschini et al.
2014/0106594 A1 4/2014 Skvoretz
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0124577 A1 5/2014 Wang et al.
2014/0124579 A1 5/2014 Ding
2014/0125842 A1 5/2014 Winegar
2014/0125853 A1 5/2014 Wang
2014/0125999 A1 5/2014 Longacre et al.
2014/0129378 A1 5/2014 Richardson
2014/0131438 A1 5/2014 Kearney
2014/0131441 A1 5/2014 Nahill et al.
2014/0131443 A1 5/2014 Smith
2014/0131444 A1 5/2014 Wang
2014/0131445 A1 5/2014 Ding et al.
2014/0131448 A1 5/2014 Xian et al.
2014/0133379 A1 5/2014 Wang et al.
2014/0136208 A1 5/2014 Maltseff et al.
2014/0140585 A1 5/2014 Wang
2014/0151453 A1 6/2014 Meier et al.
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0166759 A1 6/2014 Liu et al.
2014/0168787 A1 6/2014 Wang et al.
2014/0175165 A1 6/2014 Havens et al.
2014/0175172 A1 6/2014 Jovanovski et al.
2014/0191644 A1 7/2014 Chaney
2014/0191913 A1 7/2014 Ge et al.
2014/0197238 A1 7/2014 Lui et al.
2014/0197239 A1 7/2014 Havens et al.
2014/0197304 A1 7/2014 Feng et al.
2014/0203087 A1 7/2014 Smith et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0232930 A1 8/2014 Anderson
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0284384 A1 9/2014 Lu et al.
2014/0288933 A1 9/2014 Braho et al.
2014/0297058 A1 10/2014 Barker et al.
2014/0299665 A1 10/2014 Barber et al.
2014/0312121 A1 10/2014 Lu et al.
2014/0319220 A1 10/2014 Coyle
2014/0319221 A1 10/2014 Oberpriller et al.
2014/0326787 A1 11/2014 Barten
2014/0332590 A1 11/2014 Wang et al.
2014/0344943 A1 11/2014 Todeschini et al.
2014/0346233 A1 11/2014 Liu et al.
2014/0351317 A1 11/2014 Smith et al.
2014/0353373 A1 12/2014 Van Horn et al.
2014/0361073 A1 12/2014 Qu et al.
2014/0361082 A1 12/2014 Xian et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0001304 A1 1/2015 Todeschini
2015/0003673 A1 1/2015 Fletcher
2015/0009338 A1 1/2015 Laffargue et al.
2015/0009610 A1 1/2015 London et al.
2015/0014416 A1 1/2015 Kotlarsky et al.
2015/0021397 A1 1/2015 Rueblinger et al.
2015/0028102 A1 1/2015 Ren et al.
2015/0028103 A1 1/2015 Jiang
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0048168 A1 2/2015 Fritz et al.
2015/0049347 A1 2/2015 Laffargue et al.
2015/0051992 A1 2/2015 Smith
2015/0053766 A1 2/2015 Havens et al.
2015/0053768 A1 2/2015 Wang et al.
2015/0053769 A1 2/2015 Thuries et al.
2015/0062366 A1 3/2015 Liu et al.
2015/0063215 A1 3/2015 Wang
2015/0063676 A1 3/2015 Lloyd et al.
2015/0069130 A1 3/2015 Gannon
2015/0071819 A1 3/2015 Todeschini
2015/0083800 A1 3/2015 Li et al.
2015/0086114 A1 3/2015 Todeschini
2015/0088522 A1 3/2015 Hendrickson et al.
2015/0096872 A1 4/2015 Woodburn
2015/0099557 A1 4/2015 Pettinelli et al.
2015/0100196 A1 4/2015 Hollifield
2015/0102109 A1 4/2015 Huck
2015/0115035 A1 4/2015 Meier et al.
2015/0127791 A1 5/2015 Kosecki et al.
2015/0128116 A1 5/2015 Chen et al.
2015/0129659 A1 5/2015 Feng et al.
2015/0133047 A1 5/2015 Smith et al.
2015/0134470 A1 5/2015 Hejl et al.
2015/0136851 A1 5/2015 Harding et al.
2015/0136854 A1 5/2015 Lu et al.
2015/0142492 A1 5/2015 Kumar
2015/0144692 A1 5/2015 Hejl
2015/0144698 A1 5/2015 Teng et al.
2015/0144701 A1 5/2015 Xian et al.
2015/0149946 A1 5/2015 Benos et al.
2015/0161429 A1 6/2015 Xian
2015/0169925 A1 6/2015 Chen et al.
2015/0169929 A1 6/2015 Williams et al.
2015/0186703 A1 7/2015 Chen et al.
2015/0193644 A1 7/2015 Kearney et al.
2015/0193645 A1 7/2015 Colavito et al.
2015/0199957 A1 7/2015 Funyak et al.
2015/0204671 A1 7/2015 Showering
2015/0210199 A1 7/2015 Payne
2015/0220753 A1 8/2015 Zhu et al.
2015/0254485 A1 9/2015 Feng et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0171720 A1 6/2016 Todeschini
2016/0178479 A1 6/2016 Goldsmith
2016/0180678 A1 6/2016 Ackley et al.
2016/0189087 A1 6/2016 Morton et al.
2016/0125873 A1 7/2016 Braho et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.

(56) References Cited

U.S. PATENT DOCUMENTS

| | | | |
|---|---|---|---|
| 2016/0306769 | A1 | 10/2016 | Kohtz et al. |
| 2016/0314276 | A1 | 10/2016 | Sewell et al. |
| 2016/0314294 | A1 | 10/2016 | Kubler et al. |

FOREIGN PATENT DOCUMENTS

| | | | |
|---|---|---|---|
| WO | 2013173985 | A1 | 11/2013 |
| WO | 2014019130 | A1 | 2/2014 |
| WO | 2014110495 | A1 | 7/2014 |

OTHER PUBLICATIONS

U.S. Appl. No. 14/277,337 for Multipurpose Optical Reader, filed May 14, 2014 (Jovanovski et al.); 59 pages; now abandoned.
U.S. Appl. No. 14/446,391 for Multifunction Point of Sale Apparatus With Optical Signature Capture filed Jul. 30, 2014 (Good et al.); 37 pages; now abandoned.
U.S. Appl. No. 29/516,892 for Table Computer filed Feb. 6, 2015 (Bidwell et al.); 13 pages.
U.S. Appl. No. 29/523,098 for Handle for a Tablet Computer filed Apr. 7, 2015 (Bidwell et al.); 17 pages.
U.S. Appl. No. 29/528,890 for Mobile Computer Housing filed Jun. 2, 2015 (Fitch et al.); 61 pages.
U.S. Appl. No. 29/526,918 for Charging Base filed May 14, 2015 (Fitch et al.); 10 pages.
U.S. Appl. No. 14/715,916 for Evaluating Image Values filed May 19, 2015 (Ackley); 60 pages.
U.S. Appl. No. 29/525,068 for Tablet Computer With Removable Scanning Device filed Apr. 27, 2015 (Schulte et al.); 19 pages.
U.S. Appl. No. 29/468,118 for an Electronic Device Case, filed Sep. 26, 2013 (Oberpriller et al.); 44 pages.
U.S. Appl. No. 29/530,600 for Cyclone filed Jun. 18, 2015 (Vargo et al); 16 pages.
U.S. Appl. No. 14/707,123 for Application Independent DEX/UCS Interface filed May 8, 2015 (Pape); 47 pages.
U.S. Appl. No. 14/283,282 for Terminal Having Illumination and Focus Control filed May 21, 2014 (Liu et al.); 31 pages; now abandoned.
U.S. Appl. No. 14/705,407 for Method and System to Protect Software-Based Network-Connected Devices From Advanced Persistent Threat filed May 6, 2015 (Hussey et al.); 42 pages.
U.S. Appl. No. 14/704,050 for Intermediate Linear Positioning filed May 5, 2015 (Charpentier et al.); 60 pages.
U.S. Appl. No. 14/705,012 for Hands-Free Human Machine Interface Responsive to a Driver of a Vehicle filed May 6, 2015 (Fitch et al.); 44 pages.
U.S. Appl. No. 14/715,672 for Augumented Reality Enabled Hazard Display filed May 19, 2015 (Venkatesha et al.); 35 pages.
U.S. Appl. No. 14/735,717 for Indicia-Reading Systems Having an Interface With a User's Nervous System filed Jun. 10, 2015 (Todeschini); 39 pages.
U.S. Appl. No. 14/702,110 for System and Method for Regulating Barcode Data Injection Into a Running Application on a Smart Device filed May 1, 2015 (Todeschini et al.); 38 pages.
U.S. Appl. No. 14/747,197 for Optical Pattern Projector filed Jun. 23, 2015 (Thuries et al.); 33 pages.
U.S. Appl. No. 14/702,979 for Tracking Battery Conditions filed May 4, 2015 (Young et al.); 70 pages.
U.S. Appl. No. 29/529,441 for Indicia Reading Device filed Jun. 8, 2015 (Zhou et al.); 14 pages.
U.S. Appl. No. 14/747,490 for Dual-Projector Three-Dimensional Scanner filed Jun. 23, 2015 (Jovanovski et al.); 40 pages.
U.S. Appl. No. 14/740,320 for Tactile Switch For a Mobile Electronic Device filed Jun. 16, 2015 (Bamdringa); 38 pages.
U.S. Appl. No. 14/740,373 for Calibrating a Volume Dimensioner filed Jun. 16, 2015 (Ackley et al.);63 pages.

* cited by examiner

SINGLE MOTOR DYNAMIC RIBBON FEEDBACK SYSTEM FOR A PRINTER

FIELD OF THE INVENTION

The present invention relates to controlling the forces on a print ribbon in a printer, especially, but not limited to ribbons employed in thermal transfer printers.

BACKGROUND

Generally speaking changes in ribbon forces will dramatically affect the print registration ability of any thermal transfer printer. This is easily observed especially when the ribbon diameter changes from a fresh ribbon roll to an empty roll. Having the ability to control the ribbon tension dynamically as the diameter of ribbon changes greatly improves the print registration capability.

There are printers with the ability to control the ribbon tension dynamically. Usually this is accomplished by using an individual DC motor on each of the ribbon rewind and ribbon supply spindles with a two-encoder feedback system. Print precision on these performance class printers is excellent. However, having two motors affects final product cost and system complication.

Therefore, a need exists for a printer where the ribbon tension can be controlled using a single motor.

SUMMARY

Accordingly, in one aspect, the present invention embraces a printer for printing media.

In an exemplary embodiment, the printer comprises a rotatable ribbon supply spindle; a rotatable take-up ribbon spindle; at least one sensor that outputs ribbon width and diameter of a ribbon loaded on the rotatable ribbon supply spindle; and a sensor which outputs ribbon diameter on the ribbon loaded on the rotatable take-up ribbon spindle. The printer is comprised of a drive system configured to rotate the rotatable take-up ribbon spindle. The drive system provides rotation to the rotatable ribbon supply via tension on the ribbon loaded on the rotatable ribbon supply spindle and taken-up on the rotatable take-up ribbon spindle. The printer is also provided with firmware. The firmware is communicatively linked to the at least one sensor for determining ribbon width and diameter of the ribbon loaded on the rotatable ribbon supply spindle, and communicatively linked to the sensor for determining ribbon diameter on the ribbon loaded on the rotatable take-up ribbon spindle. The firmware is further communicatively linked to the drive system. The firmware is configured to calculate ribbon tension at the ribbon supply spindle from the output of the at least one sensor on the rotatable ribbon supply spindle. The firmware is further configured to calculate the torque required on the ribbon on the rotatable ribbon take-up spindle to match the ribbon tension at the take-up spindle to the ribbon tension at the rotatable ribbon supply spindle based upon the calculated total tension at the rotatable ribbon supply spindle and the output from the sensor on the ribbon take-up spindle. The firmware being configured to adjust the drive system so that the torque at the rotatable take-up spindle is the calculated torque required to match the ribbon tension at the rotatable ribbon take-up spindle to the ribbon tension at the rotatable ribbon supply spindle.

In another exemplary embodiment, the at least one sensor that outputs ribbon width and diameter of a ribbon loaded on the rotatable ribbon supply spindle is comprised of an encoder sensor that outputs the diameter of the ribbon loaded on the rotatable ribbon supply spindle and a second sensor that outputs the width of the ribbon loaded on the rotatable ribbon supply spindle. The encoder sensor is disposed on a base of the rotatable ribbon supply spindle. The second sensor is disposed on the rotatable ribbon supply spindle.

In another exemplary embodiment, the ribbon width is proportional to the torque at the rotatable ribbon supply spindle.

In another exemplary embodiment, the encoder sensor rotates with the rotatable supply spindle. The encoder sensor having a rotation rate proportional to the radius of the ribbon loaded on the rotatable ribbon supply spindle. The encoder sensor on the ribbon supply spindle is configured to determine the rotation rate based upon a number of encoder interrupts for a given period.

In another exemplary embodiment of the printer, the sensor which outputs ribbon diameter on the ribbon loaded on the rotatable take-up ribbon spindle is an encoder sensor that rotates with the rotatable ribbon take-up spindle. The encoder sensor at the rotatable ribbon take-up spindle has a rotation rate proportional to the ribbon radius at the rotatable ribbon take-up spindle. The encoder sensor at the rotatable ribbon take-up spindle is configured determine the rotation rate based upon a number of encoder interrupts for a given period.

In yet another exemplary embodiment, the firmware calculation for ribbon tension at the rotatable ribbon supply spindle is SRT/SRR, where SRT is the torque at the supply ribbon spindle, and SRR is the supply ribbon radius.

In another exemplary embodiment, the firmware calculation of torque on the ribbon on the rotatable ribbon take-up spindle required to match the ribbon tension at the take-up spindle to the ribbon tension at the rotatable ribbon supply spindle is (SRT/SRR)*TRR, where TRR is the radius of the ribbon at the rotatable ribbon take-up spindle.

In another exemplary embodiment, the drive system is an electronic motor. The firmware is configured to adjust current to the motor so that the torque at the rotatable take-up spindle is the calculated torque required to match the ribbon tension at the rotatable ribbon take-up spindle to the ribbon tension at the rotatable ribbon supply spindle.

In yet another exemplary embodiment, the printer further includes spring wraps on the rotatable ribbon supply spindle. The spring wraps provide torque to the ribbon on the rotatable ribbon supply spindle.

In yet another exemplary embodiment, the firmware is configured to periodically adjust the drive system based upon periodic calculations of the torque on the ribbon on the rotatable ribbon take-up spindle required to match the ribbon tension at the take-up spindle to the ribbon tension at the rotatable ribbon supply spindle based upon the calculated total tension at the rotatable ribbon supply spindle and the output from the sensor on the ribbon take-up spindle.

In another aspect, the present invention embraces a printer with a dynamic ribbon feedback system.

In an exemplary embodiment, the printer comprises a rotatable ribbon supply spindle; an encoder sensor for determining the diameter of a ribbon loaded on the ribbon supply spindle; a sensor for determining width of the ribbon loaded on the ribbon supply spindle; a rotatable ribbon take-up spindle for taking up the ribbon; an encoder sensor on the ribbon take-up spindle for determining the diameter of the ribbon on the take-up spindle; and a drive system configured to rotate the ribbon take-up spindle. The drive system is powered by an electric power supply. The drive system further provides rotation to the rotatable ribbon supply spindle via tension on a ribbon loaded on the rotatable ribbon supply spindle and taken-upon the rotatable take-up ribbon spindle. The printer further comprises firmware which is communicatively linked to receive sensor outputs from the encoder sensor on the ribbon supply spindle, the sensor for determining ribbon width, and the encoder sensor on the ribbon take-up spindle. The firmware is configured to determine torque in the ribbon at the supply spindle based upon the output from the sensor for determining width of the ribbon on the ribbon supply spindle. The firmware is configured to calculate the total tension in the ribbon supply based upon the torque determined at in the ribbon at the supply spindle and based upon the output from the encoder sensor on the ribbon supply spindle. The firmware calculation is: SRT/SRR, where SRT is Supply Ribbon Torque and SRR is Supply Ribbon Radius. The firmware is further configured to calculate the torque in the rotatable ribbon take-up spindle required to match the ribbon tension in the take-up spindle to the ribbon tension in the supply spindle based upon the calculated total tension in the ribbon supply and the output from the encoder sensor on the ribbon take-up spindle. The firmware calculation is: (SRT/SRR)*TRR, where TRR is the radius of the ribbon at the take-up spindle. The firmware is communicatively linked to the electric power supply and configured to control current supplied to the drive system. The current is proportional to a rate of rotation of the drive system and the take-up spindle. The firmware is further configured to adjust the current supplied to the drive system so that the torque at the take-up spindle is the calculated torque required to match the ribbon tension in the take-up spindle to the ribbon tension in the supply spindle.

In another exemplary embodiment, the printer further comprises spring wraps on the rotatable ribbon supply spindle. The spring wraps secure the ribbon on the rotatable ribbon supply spindle.

In another exemplary embodiment, the ribbon width is proportional to the torque at the rotatable ribbon supply spindle.

In another exemplary embodiment, the rotatable ribbon supply spindle is comprised of multiple segments. The first segment of the multiple segments is adjacent to a base. Each subsequent segment of the multiple segments being adjacent to the previous segment of the multiple segments. The sensor for determining ribbon width is comprised of a commutator disposed circumferentially on the first segment of the spindle; at least two brushes connected to a voltage source and disposed generally on either side of and in electrical contact the commutator. The voltage source, the brushes, and the commutator form a closed electrical circuit. The sensor further comprises a c-shaped conductive spring disposed on each of the multiple segments. The c-shaped conductive spring has two ends and a center portion. The c-shaped conductive springs are in an uncompressed state in the absence of a printer ribbon over the one or more c-shaped conductive springs. The c-shaped conductive springs are in a compressed state in the presence of a printer ribbon positioned over the one or more c-shaped conductive springs. The c-shaped conductive spring on each segment of the multiple segments has a length such that when the c-shaped conductive spring is in the compressed state, the two ends of the c-shaped conductive spring make electrical contact with the commutator or the c-shaped conductive spring of a previous segment completing an additional electrical circuit in parallel with the closed electrical circuit. The sensor further includes a resistor. The resister is disposed proximate to the center portions of each of the c-shaped conductive springs and in electrical contact with the center portion of the c-shaped conductive springs. Also provided is a resistance meter. The resistance meter is connected to the closed electrical circuit, such that the reading on the meter indicates how many additional parallel circuits are completed; the number of additional parallel circuits completed indicating the approximate ribbon width.

In another exemplary embodiment, the encoder sensor on the rotatable ribbon supply spindle is disposed on the base of the rotatable ribbon supply spindle and rotates with the rotatable ribbon supply spindle. The encoder sensor rotation rate is proportional to the ribbon radius. The encoder sensor on the ribbon supply spindle is configured to determine the rotation rate based upon a number of encoder interrupts for a given period.

In yet another exemplary embodiment, the encoder sensor on the ribbon take-up spindle has a rotation rate proportional to the ribbon radius. The encoder sensor on the ribbon take-up spindle is configured to determine the rotation rate based upon a number of encoder interrupts for a given period.

In another aspect, the present invention embraces a method of controlling ribbon tension on a printer of the type a rotatable ribbon supply spindle, a rotatable ribbon take-up spindle, and a motor driving the ribbon take-up spindle.

In an exemplary embodiment, the method includes the steps of: sensing the diameter of the ribbon on the ribbon supply spindle; sensing the ribbon width on the ribbon supply spindle; calculating tension on the ribbon at the ribbon supply spindle, the tension based upon the first and second sensing steps; sensing the ribbon diameter of the ribbon at ribbon take-up spindle; calculating the torque required to match tensions between the ribbon supply and the ribbon take-up based upon the first calculating step and the third sensing step; and adjusting the motor driving the ribbon take-up spindle to supply the required torque found in the second calculating step.

In another exemplary embodiment of the method, the first calculating step is accomplished with firmware. The first calculating step is comprised of the steps of: receiving information about the diameter of the ribbon on the ribbon supply spindle from the first sensing step; receiving information about the width of the ribbon on the ribbon supply spindle from the second sensing step; converting the information about the width of the ribbon into a torque; and dividing the torque by the ribbon radius derived from the information about diameter or the ribbon to obtain a supply ribbon tension.

In another exemplary embodiment of the method, the second calculating step is accomplished with the firmware. The second calculating step is comprised of the steps of: receiving information about the diameter of the ribbon on the take-up spindle from the third sensing step; and multiplying the ribbon radius on the take-up spindle by the supply ribbon tension.

In yet another exemplary embodiment of the method, the adjusting step is accomplished with the firmware. The firmware is configured to control current supplied to the motor.

The foregoing illustrative summary, as well as other exemplary objectives and/or advantages of the invention, and the manner in which the same are accomplished, are further explained within the following detailed description and its accompanying drawings.

DETAILED DESCRIPTION

The present invention embraces a printer with a single motor system to match torques between ribbon supply and ribbon take-up.

Figure 1:
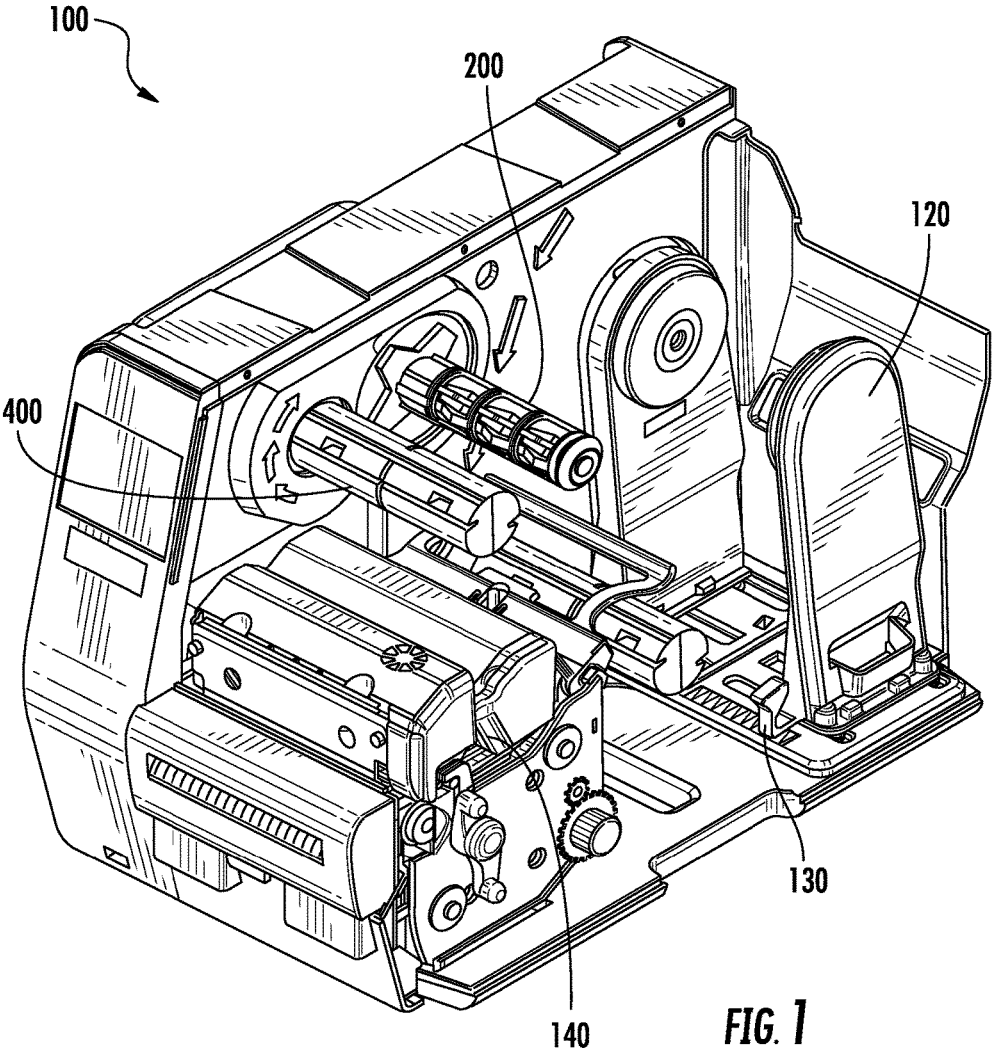
FIG. 1 schematically depicts an exemplary embodiment of a front view of the printer in accordance with the present invention.
Figure 2:
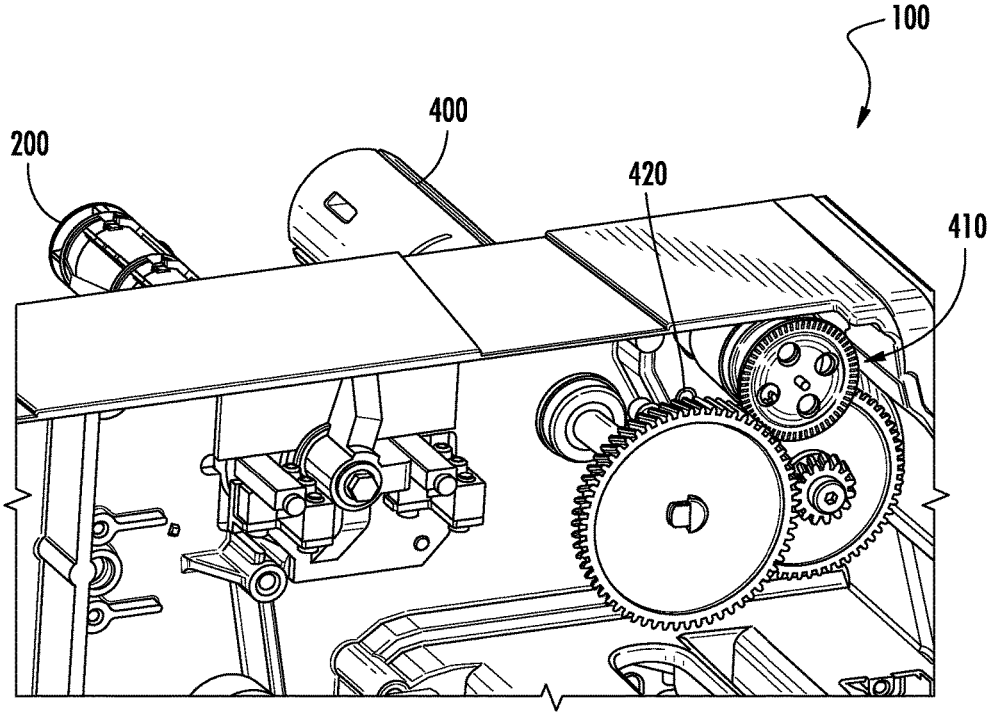
FIG. 2 schematically depicts an exemplary embodiment of a back view of the printer in accordance with the present invention.

FIGS. 1 and 2 depict a front and back view of a printer in accordance with an exemplary embodiment of the invention. Referring to the FIG. 1, a printer (100) is provided with a rotatable ribbon supply spindle (200) and a rotatable take-up ribbon spindle (400). A media holder (120) with width adjustment (130) and print mechanism (140) is provided.

Looking at FIG. 2, the printer includes a drive system (420) configured to rotate the rotatable take-up ribbon spindle (400). The drive system (420) further provides rotation to the rotatable ribbon supply (200) via tension on a ribbon loaded on the rotatable ribbon supply spindle (200) and taken-up on the rotatable take-up ribbon spindle (400). The drive system (420) is a single motor which can provide rotation to the take-up spindle (400) via gear mechanisms as shown or by other means known in the art. For example, the drive system 420) is preferably an electric motor.

A sensor (410) which outputs ribbon diameter on the ribbon loaded on the rotatable take-up ribbon spindle (400) is part of the drive system (420).

In an exemplary embodiment, the sensor (410) which outputs ribbon diameter on the ribbon loaded on the rotatable take-up ribbon spindle (400) is an encoder sensor that rotates with the rotatable ribbon take-up spindle (400). The encoder sensor (410) has a rotation rate proportional to the ribbon radius at the rotatable ribbon take-up spindle (400). The encoder sensor (410) is configured to determine the rotation rate based upon a number of encoder interrupts for a given period.

Figure 3:
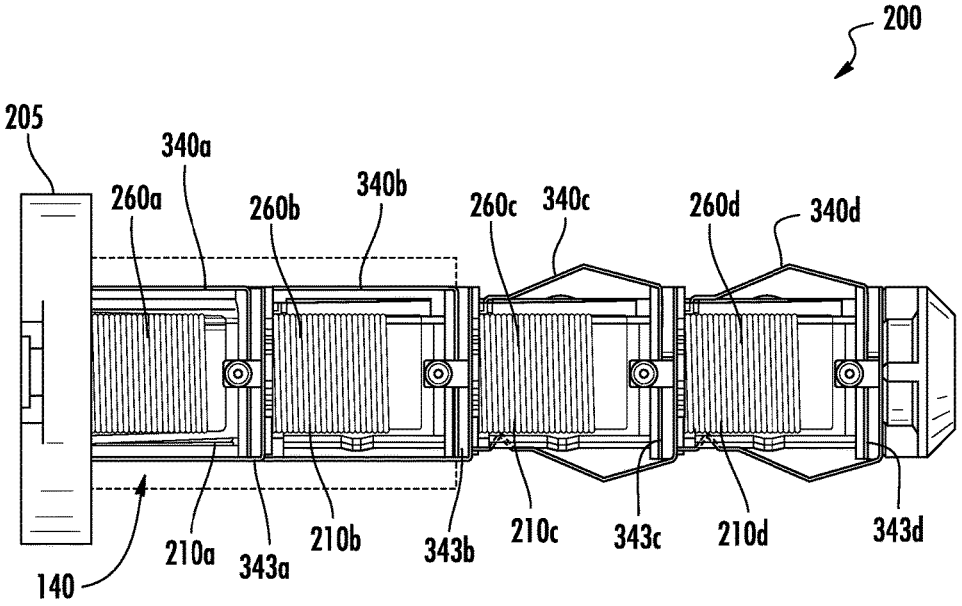
FIG. 3 schematically depicts an exemplary embodiment of a ribbon supply spindle and the sensor for determining supply ribbon width in accordance with the present invention.
Figure 4:
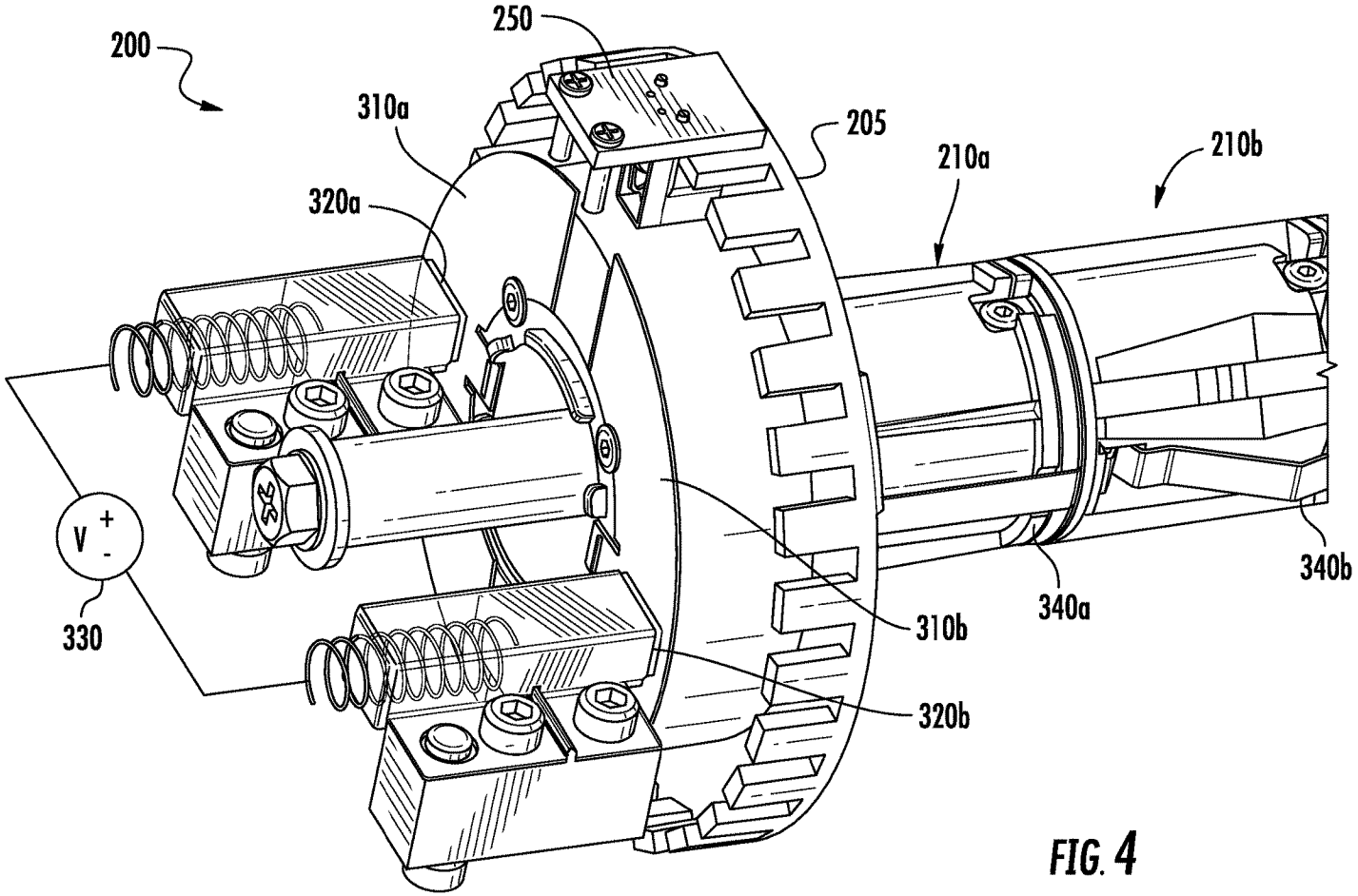
FIG. 4 schematically depicts an exemplary embodiment of the base of the ribbon supply spindle and the sensor for determining supply spindle diameter depicted in FIG. 3 in accordance with the present invention.

FIGS. 3 and 4 depict details of the ribbon supply spindle (200). The ribbon supply spindle (200) shown in FIG. 3 is comprised of a base (205) and multiple segments, 210*a*-210*d*, although more or less segments are possible. The Figure shows a ribbon (140) loaded onto the ribbon supply spindle (200). The ribbon (140) only covers two segments, (210*a*-210*b*) of the ribbon supply spindle (200). The segments should preferably be of equal length, for example, each segment (210*a*-210*d*) could be 1 inch. Each segment (210*a*-210*d*) is provided with spring wraps (260*a*-260*d*). Each spring wrap (260*a*-260*d*) provides an equal amount of torque to the ribbon (140) loaded over the corresponding segments. For example, a spring wrap on each segment could provide 20 N-m (Newton-meters) of torque for each segment a ribbon is loaded on. Using this example, in FIG. 3, the ribbon (140) covers two segments (210*a* and 210*b*) with spring wraps (260*a* and 260*b*), thus providing 40 N-m of torque to the ribbon (140).

The printer (100) includes a sensor which outputs the width and diameter of the ribbon loaded on the ribbon supply spindle (200). In the exemplary embodiment depicted in FIGS. 1-4, the sensor is two sensors. The sensor outputting the diameter of the ribbon can be seen in FIG. 4. The ribbon diameter sensor is an encoder sensor (250), that is preferably a rotary encoder, disposed on the base (205) of the ribbon supply spindle (200). The encoder sensor (250) has a rotation rate proportional to the half the diameter (or the radius) of the ribbon (140) loaded on the ribbon supply spindle (200). The encoder sensor (250) is configured to determine the rotation rate and therefore the ribbon diameter, based upon a number of encoder interrupts in a given rotation period.

A sensor that outputs a ribbon width when the ribbon is loaded on the rotatable ribbon supply spindle (200) is comprised of several components, some of which are depicted in FIG. 3, and some of which are best depicted in FIG. 4. Referring to FIG. 4, the sensor is comprised, in part, of a commutator in two parts (310*a* and 310*b*) which is disposed circumferentially on the base (205) proximate to the first segment (210*a*) of the supply spindle (200). Two brushes (320*a*, 320*b*) are in electrical contact with corresponding commutator sections (310*a* and 310*b*) and are connected to a voltage source (330). Referring now back to FIG. 3, the sensor further comprises c-shaped conductive springs (340*a*-340*h*) disposed on each of the segments (210*a*-210*h*). One c-shaped conductive spring corresponds to each segment (210*a*-210*h*) of the ribbon supply spindle (200). Each c-shaped conductive spring (340*a*-340*d*) has two ends and a center portion. The c-shaped conductive springs (340*a*-340*d*) are in an uncompressed state in the absence of a printer ribbon loaded onto the ribbon supply spindle (200). The c-shaped conductive springs (340*a*-340*d*) are in a compressed state when a printer ribbon is positioned over one or more of the c-shaped conductive springs (340*a*-340*d*). That is, if the printer ribbon is the length of two segments, then c-shaped conductive springs (340*a*) and (340*b*) will be in a compressed state.

Each of the c-shaped conductive spring (340*a*-340*d*) on each segment (210*a*-210*d*) of the multiple segments has a length such that when the c-shaped conductive spring (340*a*-340*d*) is in the compressed state, the two ends of the c-shaped conductive spring (340*a*-340*d*) make electrical contact with the commutator (310*a* and 310*b*) or the c-shaped conductive spring of a previous segment, therefore completing an additional electrical circuit in parallel with the closed electrical circuit.

Each of the center portions of the c-shaped conductive springs (340*a*-340*d*) includes a resistive element (343*a*-343*d*) which forms part of the conductive path in the c-shaped conductive springs (340*a*-340*d*). A resistance meter (not shown) may be connected to the closed electrical circuit, such that the reading on the meter indicates how many additional parallel circuits are completed. The number of additional parallel circuits completed indicates the approximate ribbon width.

It is to be understood that even if a ribbon only covers a portion of the segment (210*a*-210*d*), the sensor cannot distinguish between partial segments and full segments. Therefore, if for example, each segment is one inch long, and a ribbon is loaded on the ribbon supply spindle which is 1.25 inches, the ribbon width sensor will output a 2 inch width ribbon. Because the width of the ribbon on the supply spindle will be used to help match torques between the supply spindle and the take-up spindle, potential errors due to partial segment coverage by the ribbon is possible. However, any error caused by this will be within the objective of matching torques between supply and take-up.

Figure 5:
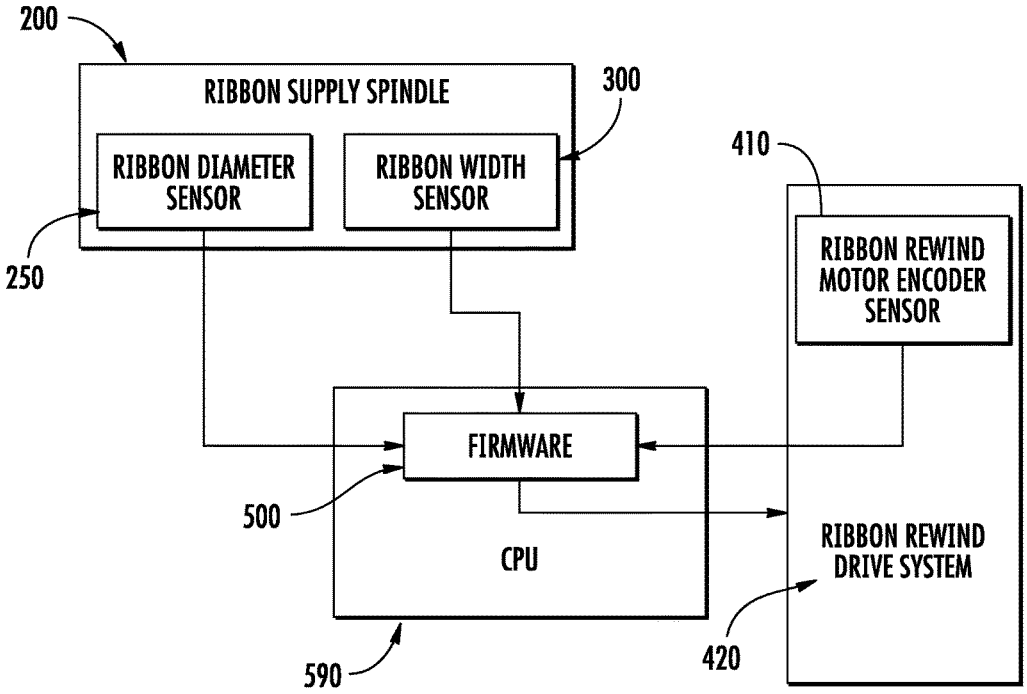
FIG. 5 schematically depicts an exemplary embodiment of the communicative links between the firmware, the supply ribbon spindle sensors, the ribbon rewind sensor, and the ribbon rewind drive system in accordance with the present invention.

The printer, in accordance with exemplary embodiments of the present invention includes firmware. FIG. 5 depicts the relationship between the firmware and other printer components.

Referring to FIG. 5, firmware (500) may be contained in a central processing unit (CPU) (590) on the printer or a similar control entity as is known in the art. The firmware is communicatively linked to the sensor for determining ribbon width (300) and the encoder sensor for determining ribbon diameter (250) of the ribbon loaded on the rotatable ribbon supply spindle (200). The firmware (500) is also communicatively linked to the sensor for determining ribbon diameter (410) on the ribbon loaded on the take-up ribbon spindle (400). Finally, the firmware (500) is communicatively linked to the drive system (420).

Figure 6:
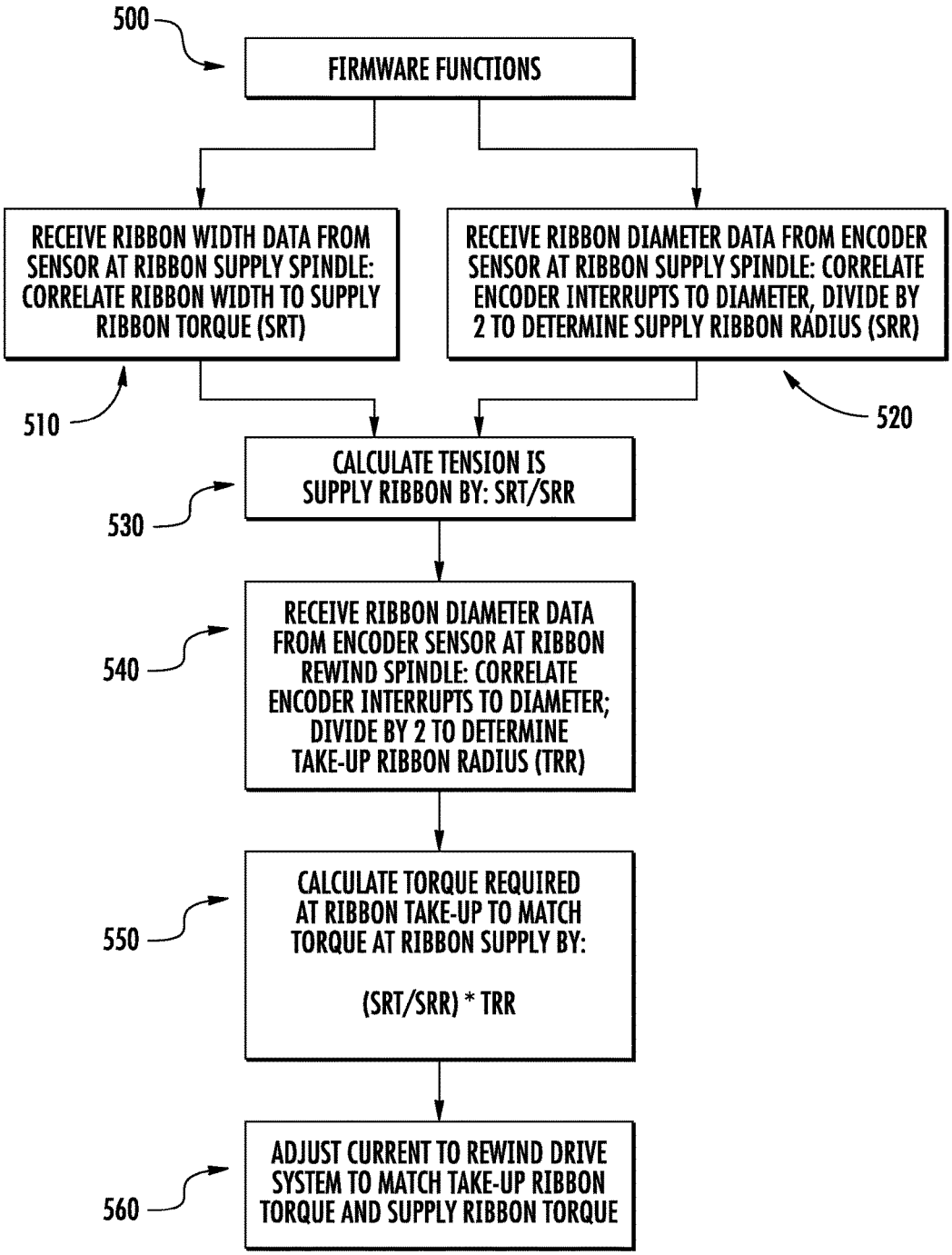
FIG. 6 schematically depicts in a flow chart an exemplary embodiment of the firmware functions to match supply ribbon torque and rewind ribbon torque in accordance with the present invention.

FIG. 6 depicts an exemplary embodiment of the firmware (500) functions in flow chart form. The firmware (500) is configured to (510) receive the ribbon width sensor output on the supply spindle and correlate the width to supply ribbon torque (SRT). The firmware (500) is configured also (520) to receive the ribbon diameter sensor output on the supply spindle, correlating encoder interrupts to diameter of the ribbon and thus interpolating to get the supply ribbon radius (SRR). The firmware (500) is configured then (530) to calculate tension at the ribbon supply spindle by dividing SRT/SRR. The firmware (500) is further configured (540) to receive the output of the ribbon diameter sensor at the take-up spindle, correlating encoder interrupts to ribbon diameter and interpolating to determine rewind (take-up) ribbon radius (TRR). The firmware (500) is further configured to (550) calculate the torque required at ribbon take-up to match the torque at ribbon supply by: (SRT/SRR)*TRR. Finally, the firmware (500) is configured to (560) adjust the current in the drive system, the drive system comprising an electric motor as described hereinbefore, to match the take-up ribbon torque to the supply ribbon torque.

The present invention also embraces a method of controlling ribbon tension on a printer, such as a printer described hereinbefore in conjunction with FIGS. 1-6.

Figure 7:
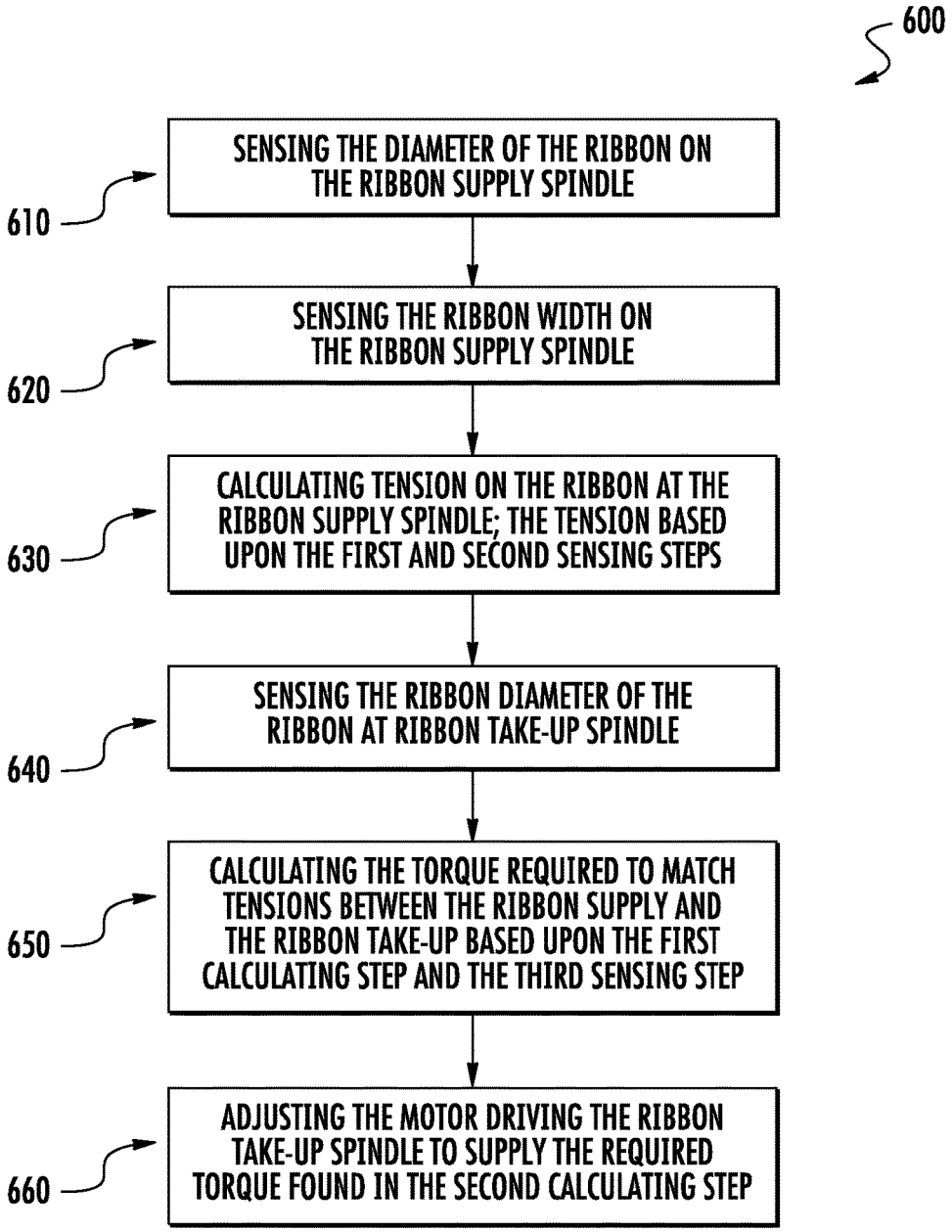
FIG. 7 schematically depicts in a flow chart, a method of controlling ribbon tension on a printer in accordance with the present invention.

In an exemplary embodiment, referring to FIG. 7, the method (600) comprises the steps of: (610) sensing the diameter of the ribbon on the ribbon supply spindle; (620) sensing the ribbon width on the ribbon supply spindle; (630) calculating tension on the ribbon at the ribbon supply spindle, the tension based upon the first and second sensing steps; (640) sensing the ribbon diameter of the ribbon at ribbon take-up spindle; (650) calculating the torque required to match tensions between the ribbon supply and the ribbon take-up based upon the first calculating step and the third sensing step; and (660) adjusting the motor driving the ribbon take-up spindle to supply the required torque found in the second calculating step.

Figure 8:
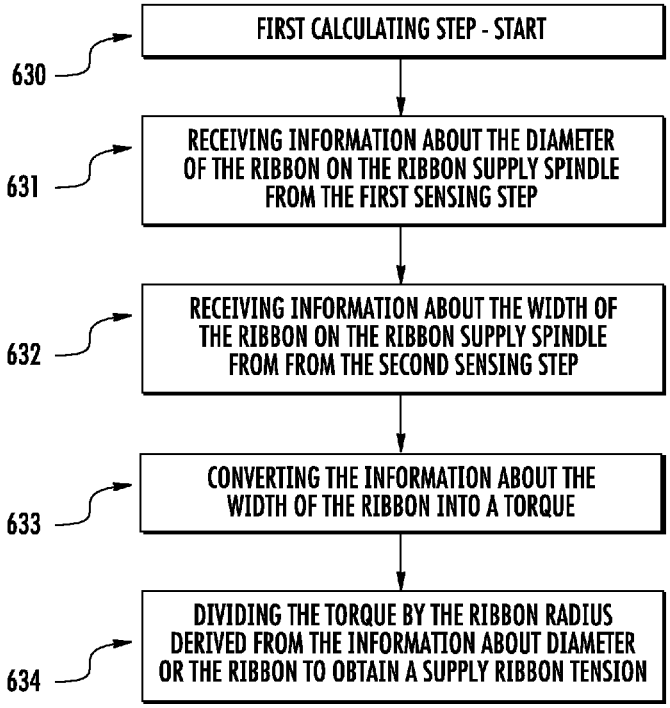
FIG. 8 schematically depicts in a flow chart, the first calculating step of the method of controlling ribbon tension on a printer of FIG. 7 in accordance with the present invention.

Referring now to FIG. 8, the first calculating step (630) from FIG. 7, comprises the steps of: (631) receiving information about the diameter of the ribbon on the ribbon supply spindle from the first sensing step; (632) receiving information about the width of the ribbon on the ribbon supply spindle from the second sensing step; (633) converting the information about the width of the ribbon into a torque; and (634) dividing the torque by the ribbon radius derived from the information about diameter or the ribbon to obtain a supply ribbon tension. The first calculating step (630) is preferably accomplished with firmware provided to the printer as described hereinbefore.

Figure 9:
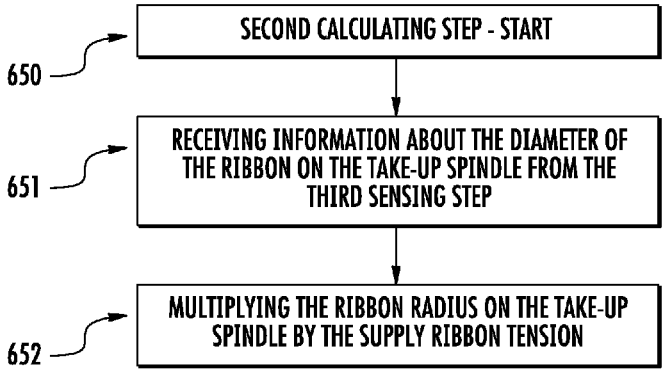
FIG. 9 schematically depicts in a flow chart, the second calculating step of the method of controlling ribbon tension on a printer of FIG. 7 in accordance with the present invention.

Referring now to FIG. 9, the second calculating step (650) is comprised of the steps of: (651) receiving information about the diameter of the ribbon on the take-up spindle from the third sensing step; and (652) multiplying the ribbon radius on the take-up spindle by the supply ribbon tension. The second calculating step (650) is also accomplished with firmware provided to the printer.

Thus, the method (600) as described in conjunction with FIGS. 7-9 allows the printer to match ribbon torque and tensions between the ribbon supply spindle and the ribbon take-up spindle by adjusting the current to the drive system.

To supplement the present disclosure, this application incorporates entirely by reference the following commonly assigned patents, patent application publications, and patent applications:

U.S. Pat. No. 6,832,725; U.S. Pat. No. 7,128,266; U.S. Pat. No. 7,159,783; U.S. Pat. No. 7,413,127; U.S. Pat. No. 7,726,575; U.S. Pat. No. 8,294,969; U.S. Pat. No. 8,317,105; U.S. Pat. No. 8,322,622; U.S. Pat. No. 8,366,005; U.S. Pat. No. 8,371,507; U.S. Pat. No. 8,376,233; U.S. Pat. No. 8,381,979; U.S. Pat. No. 8,390,909; U.S. Pat. No. 8,408,464; U.S. Pat. No. 8,408,468; U.S. Pat. No. 8,408,469; U.S. Pat. No. 8,424,768; U.S. Pat. No. 8,448,863; U.S. Pat. No. 8,457,013; U.S. Pat. No. 8,459,557; U.S. Pat. No. 8,469,272; U.S. Pat. No. 8,474,712; U.S. Pat. No. 8,479,992; U.S. Pat. No. 8,490,877; U.S. Pat. No. 8,517,271; U.S. Pat. No. 8,523,076; U.S. Pat. No. 8,528,818; U.S. Pat. No. 8,544,737; U.S. Pat. No. 8,548,242; U.S. Pat. No. 8,548,420; U.S. Pat. No. 8,550,335; U.S. Pat. No. 8,550,354; U.S. Pat. No. 8,550,357; U.S. Pat. No. 8,556,174; U.S. Pat. No. 8,556,176; U.S. Pat. No. 8,556,177; U.S. Pat. No. 8,559,767; U.S. Pat. No. 8,599,957; U.S. Pat. No. 8,561,895; U.S. Pat. No. 8,561,903; U.S. Pat. No. 8,561,905; U.S. Pat. No. 8,565,107; U.S. Pat. No. 8,571,307; U.S. Pat. No. 8,579,200; U.S. Pat. No. 8,583,924; U.S. Pat. No. 8,584,945; U.S. Pat. No. 8,587,595; U.S. Pat. No. 8,587,697; U.S. Pat. No. 8,588,869; U.S. Pat. No. 8,590,789; U.S. Pat. No. 8,596,539; U.S. Pat. No. 8,596,542; U.S. Pat. No. 8,596,543; U.S. Pat. No. 8,599,271; U.S. Pat. No. 8,599,957; U.S. Pat. No. 8,600,158; U.S. Pat. No. 8,600,167; U.S. Pat. No. 8,602,309; U.S. Pat. No. 8,608,053; U.S. Pat. No. 8,608,071; U.S. Pat. No. 8,611,309; U.S. Pat. No. 8,615,487; U.S. Pat. No. 8,616,454; U.S. Pat. No. 8,621,123; U.S. Pat. No. 8,622,303; U.S. Pat. No. 8,628,013; U.S. Pat. No. 8,628,015; U.S. Pat. No. 8,628,016; U.S. Pat. No. 8,629,926; U.S. Pat. No. 8,630,

491; U.S. Pat. No. 8,635,309; U.S. Pat. No. 8,636,200; U.S. Pat. No. 8,636,212; U.S. Pat. No. 8,636,215; U.S. Pat. No. 8,636,224; U.S. Pat. No. 8,638,806; U.S. Pat. No. 8,640,958; U.S. Pat. No. 8,640,960; U.S. Pat. No. 8,643,717; U.S. Pat. No. 8,646,692; U.S. Pat. No. 8,646,694; U.S. Pat. No. 8,657,200; U.S. Pat. No. 8,659,397; U.S. Pat. No. 8,668,149; U.S. Pat. No. 8,678,285; U.S. Pat. No. 8,678,286; U.S. Pat. No. 8,682,077; U.S. Pat. No. 8,687,282; U.S. Pat. No. 8,692,927; U.S. Pat. No. 8,695,880; U.S. Pat. No. 8,698,949; U.S. Pat. No. 8,717,494; U.S. Pat. No. 8,717,494; U.S. Pat. No. 8,720,783; U.S. Pat. No. 8,723,804; U.S. Pat. No. 8,723,904; U.S. Pat. No. 8,727,223; U.S. Pat. No. D702,237; U.S. Pat. No. 8,740,082; U.S. Pat. No. 8,740,085; U.S. Pat. No. 8,746,563; U.S. Pat. No. 8,750,445; U.S. Pat. No. 8,752,766; U.S. Pat. No. 8,756,059; U.S. Pat. No. 8,757,495; U.S. Pat. No. 8,760,563; U.S. Pat. No. 8,763,909; U.S. Pat. No. 8,777,108; U.S. Pat. No. 8,777,109; U.S. Pat. No. 8,779,898; U.S. Pat. No. 8,781,520; U.S. Pat. No. 8,783,573; U.S. Pat. No. 8,789,757; U.S. Pat. No. 8,789,758; U.S. Pat. No. 8,789,759; U.S. Pat. No. 8,794,520; U.S. Pat. No. 8,794,522; U.S. Pat. No. 8,794,525; U.S. Pat. No. 8,794,526; U.S. Pat. No. 8,798,367; U.S. Pat. No. 8,807,431; U.S. Pat. No. 8,807,432; U.S. Pat. No. 8,820,630; U.S. Pat. No. 8,822,848; U.S. Pat. No. 8,824,692; U.S. Pat. No. 8,824,696; U.S. Pat. No. 8,842,849; U.S. Pat. No. 8,844,822; U.S. Pat. No. 8,844,823; U.S. Pat. No. 8,849,019; U.S. Pat. No. 8,851,383; U.S. Pat. No. 8,854,633; U.S. Pat. No. 8,866,963; U.S. Pat. No. 8,868,421; U.S. Pat. No. 8,868,519; U.S. Pat. No. 8,868,802; U.S. Pat. No. 8,868,803; U.S. Pat. No. 8,870,074; U.S. Pat. No. 8,879,639; U.S. Pat. No. 8,880,426; U.S. Pat. No. 8,881,983; U.S. Pat. No. 8,881,987; U.S. Pat. No. 8,903,172; U.S. Pat. No. 8,908,995; U.S. Pat. No. 8,910,870; U.S. Pat. No. 8,910,875; U.S. Pat. No. 8,914,290; U.S. Pat. No. 8,914,788; U.S. Pat. No. 8,915,439; U.S. Pat. No. 8,915,444; U.S. Pat. No. 8,916,789; U.S. Pat. No. 8,918,250; U.S. Pat. No. 8,918,564; U.S. Pat. No. 8,925,818; U.S. Pat. No. 8,939,374; U.S. Pat. No. 8,942,480; U.S. Pat. No. 8,944,313; U.S. Pat. No. 8,944,327; U.S. Pat. No. 8,944,332; U.S. Pat. No. 8,950,678; U.S. Pat. No. 8,967,468; U.S. Pat. No. 8,971,346; U.S. Pat. No. 8,976,030; U.S. Pat. No. 8,976,368; U.S. Pat. No. 8,978,981; U.S. Pat. No. 8,978,983; U.S. Pat. No. 8,978,984; U.S. Pat. No. 8,985,456; U.S. Pat. No. 8,985,457; U.S. Pat. No. 8,985,459; U.S. Pat. No. 8,985,461; U.S. Pat. No. 8,988,578; U.S. Pat. No. 8,988,590; U.S. Pat. No. 8,991,704; U.S. Pat. No. 8,996,194; U.S. Pat. No. 8,996,384; U.S. Pat. No. 9,002,641; U.S. Pat. No. 9,007,368; U.S. Pat. No. 9,010,641; U.S. Pat. No. 9,015,513; U.S. Pat. No. 9,016,576; U.S. Pat. No. 9,022,288; U.S. Pat. No. 9,030,964; U.S. Pat. No. 9,033,240; U.S. Pat. No. 9,033,242; U.S. Pat. No. 9,036,054; U.S. Pat. No. 9,037,344; U.S. Pat. No. 9,038,911; U.S. Pat. No. 9,038,915; U.S. Pat. No. 9,047,098; U.S. Pat. No. 9,047,359; U.S. Pat. No. 9,047,420; U.S. Pat. No. 9,047,525; U.S. Pat. No. 9,047,531; U.S. Pat. No. 9,053,055; U.S. Pat. No. 9,053,378; U.S. Pat. No. 9,053,380; U.S. Pat. No. 9,058,526; U.S. Pat. No. 9,064,165; U.S. Pat. No. 9,064,167; U.S. Pat. No. 9,064,168; U.S. Pat. No. 9,064,254; U.S. Pat. No. 9,066,032; U.S. Pat. No. 9,070,032; U.S. Design Pat. No. D716,285; U.S. Design Pat. No. D723,560; U.S. Design Pat. No. D730,357; U.S. Design Pat. No. D730,901; U.S. Design Pat. No. D730,902; U.S. Design Pat. No. D733,112; U.S. Design Pat. No. D734,339; International Publication No. 2013/163789; International Publication No. 2013/173985; International Publication No. 2014/019130; International Publication No. 2014/110495; U.S. Patent Application Publication No. 2008/0185432; U.S. Patent Application Publication No. 2009/0134221; U.S. Patent Application Publication No. 2010/0177080; U.S. Patent Application Publication No. 2010/0177076; U.S. Patent Application Publication No. 2010/0177707; U.S. Patent Application Publication No. 2010/0177749; U.S. Patent Application Publication No. 2010/0265880; U.S. Patent Application Publication No. 2011/0202554; U.S. Patent Application Publication No. 2012/0111946; U.S. Patent Application Publication No. 2012/0168511; U.S. Patent Application Publication No. 2012/0168512; U.S. Patent Application Publication No. 2012/0193423; U.S. Patent Application Publication No. 2012/0203647; U.S. Patent Application Publication No. 2012/0223141; U.S. Patent Application Publication No. 2012/0228382; U.S. Patent Application Publication No. 2012/0248188; U.S. Patent Application Publication No. 2013/0043312; U.S. Patent Application Publication No. 2013/0082104; U.S. Patent Application Publication No. 2013/0175341; U.S. Patent Application Publication No. 2013/0175343; U.S. Patent Application Publication No. 2013/0257744; U.S. Patent Application Publication No. 2013/0257759; U.S. Patent Application Publication No. 2013/0270346; U.S. Patent Application Publication No. 2013/0287258; U.S. Patent Application Publication No. 2013/0292475; U.S. Patent Application Publication No. 2013/0292477; U.S. Patent Application Publication No. 2013/0293539; U.S. Patent Application Publication No. 2013/0293540; U.S. Patent Application Publication No. 2013/0306728; U.S. Patent Application Publication No. 2013/0306731; U.S. Patent Application Publication No. 2013/0307964; U.S. Patent Application Publication No. 2013/0308625; U.S. Patent Application Publication No. 2013/0313324; U.S. Patent Application Publication No. 2013/0313325; U.S. Patent Application Publication No. 2013/0342717; U.S. Patent Application Publication No. 2014/0001267; U.S. Patent Application Publication No. 2014/0008439; U.S. Patent Application Publication No. 2014/0025584; U.S. Patent Application Publication No. 2014/0034734; U.S. Patent Application Publication No. 2014/0036848; U.S. Patent Application Publication No. 2014/0039693; U.S. Patent Application Publication No. 2014/0042814; U.S. Patent Application Publication No. 2014/0049120; U.S. Patent Application Publication No. 2014/0049635; U.S. Patent Application Publication No. 2014/0061306; U.S. Patent Application Publication No. 2014/0063289; U.S. Patent Application Publication No. 2014/0066136; U.S. Patent Application Publication No. 2014/0067692; U.S. Patent Application Publication No. 2014/0070005; U.S. Patent Application Publication No. 2014/0071840; U.S. Patent Application Publication No. 2014/0074746; U.S. Patent Application Publication No. 2014/0076974; U.S. Patent Application Publication No. 2014/0078341; U.S. Patent Application Publication No. 2014/0078345; U.S. Patent Application Publication No. 2014/0097249; U.S. Patent Application Publication No. 2014/0098792; U.S. Patent Application Publication No. 2014/0100813; U.S. Patent Application Publication No. 2014/0103115; U.S. Patent Application Publication No. 2014/0104413; U.S. Patent Application Publication No. 2014/0104414; U.S. Patent Application Publication No. 2014/0104416; U.S. Patent Application Publication No. 2014/0104451; U.S. Patent Application Publication No. 2014/0106594; U.S. Patent Application Publication No. 2014/0106725; U.S. Patent Application Publication No. 2014/0108010; U.S. Patent Application Publication No. 2014/0108402; U.S. Patent Application Publication No. 2014/0110485; U.S.

Patent Application Publication No. 2014/0114530; U.S. Patent Application Publication No. 2014/0124577; U.S. Patent Application Publication No. 2014/0124579; U.S. Patent Application Publication No. 2014/0125842; U.S. Patent Application Publication No. 2014/0125853; U.S. Patent Application Publication No. 2014/0125999; U.S. Patent Application Publication No. 2014/0129378; U.S. Patent Application Publication No. 2014/0131438; U.S. Patent Application Publication No. 2014/0131441; U.S. Patent Application Publication No. 2014/0131443; U.S. Patent Application Publication No. 2014/0131444; U.S. Patent Application Publication No. 2014/0131445; U.S. Patent Application Publication No. 2014/0131448; U.S. Patent Application Publication No. 2014/0133379; U.S. Patent Application Publication No. 2014/0136208; U.S. Patent Application Publication No. 2014/0140585; U.S. Patent Application Publication No. 2014/0151453; U.S. Patent Application Publication No. 2014/0152882; U.S. Patent Application Publication No. 2014/0158770; U.S. Patent Application Publication No. 2014/0159869; U.S. Patent Application Publication No. 2014/0166755; U.S. Patent Application Publication No. 2014/0166759; U.S. Patent Application Publication No. 2014/0168787; U.S. Patent Application Publication No. 2014/0175165; U.S. Patent Application Publication No. 2014/0175172; U.S. Patent Application Publication No. 2014/0191644; U.S. Patent Application Publication No. 2014/0191913; U.S. Patent Application Publication No. 2014/0197238; U.S. Patent Application Publication No. 2014/0197239; U.S. Patent Application Publication No. 2014/0197304; U.S. Patent Application Publication No. 2014/0214631; U.S. Patent Application Publication No. 2014/0217166; U.S. Patent Application Publication No. 2014/0217180; U.S. Patent Application Publication No. 2014/0231500; U.S. Patent Application Publication No. 2014/0232930; U.S. Patent Application Publication No. 2014/0247315; U.S. Patent Application Publication No. 2014/0263493; U.S. Patent Application Publication No. 2014/0263645; U.S. Patent Application Publication No. 2014/0267609; U.S. Patent Application Publication No. 2014/0270196; U.S. Patent Application Publication No. 2014/0270229; U.S. Patent Application Publication No. 2014/0278387; U.S. Patent Application Publication No. 2014/0278391; U.S. Patent Application Publication No. 2014/0282210; U.S. Patent Application Publication No. 2014/0284384; U.S. Patent Application Publication No. 2014/0288933; U.S. Patent Application Publication No. 2014/0297058; U.S. Patent Application Publication No. 2014/0299665; U.S. Patent Application Publication No. 2014/0312121; U.S. Patent Application Publication No. 2014/0319220; U.S. Patent Application Publication No. 2014/0319221; U.S. Patent Application Publication No. 2014/0326787; U.S. Patent Application Publication No. 2014/0332590; U.S. Patent Application Publication No. 2014/0344943; U.S. Patent Application Publication No. 2014/0346233; U.S. Patent Application Publication No. 2014/0351317; U.S. Patent Application Publication No. 2014/0353373; U.S. Patent Application Publication No. 2014/0361073; U.S. Patent Application Publication No. 2014/0361082; U.S. Patent Application Publication No. 2014/0362184; U.S. Patent Application Publication No. 2014/0363015; U.S. Patent Application Publication No. 2014/0369511; U.S. Patent Application Publication No. 2014/0374483; U.S. Patent Application Publication No. 2014/0374485; U.S. Patent Application Publication No. 2015/0001301; U.S. Patent Application Publication No. 2015/0001304; U.S. Patent Application Publication No. 2015/0003673; U.S. Patent Application Publication No. 2015/0009338; U.S. Patent Application Publication No. 2015/0009610; U.S. Patent Application Publication No. 2015/0014416; U.S. Patent Application Publication No. 2015/0021397; U.S. Patent Application Publication No. 2015/0028102; U.S. Patent Application Publication No. 2015/0028103; U.S. Patent Application Publication No. 2015/0028104; U.S. Patent Application Publication No. 2015/0029002; U.S. Patent Application Publication No. 2015/0032709; U.S. Patent Application Publication No. 2015/0039309; U.S. Patent Application Publication No. 2015/0039878; U.S. Patent Application Publication No. 2015/0040378; U.S. Patent Application Publication No. 2015/0048168; U.S. Patent Application Publication No. 2015/0049347; U.S. Patent Application Publication No. 2015/0051992; U.S. Patent Application Publication No. 2015/0053766; U.S. Patent Application Publication No. 2015/0053768; U.S. Patent Application Publication No. 2015/0053769; U.S. Patent Application Publication No. 2015/0060544; U.S. Patent Application Publication No. 2015/0062366; U.S. Patent Application Publication No. 2015/0063215; U.S. Patent Application Publication No. 2015/0063676; U.S. Patent Application Publication No. 2015/0069130; U.S. Patent Application Publication No. 2015/0071819; U.S. Patent Application Publication No. 2015/0083800; U.S. Patent Application Publication No. 2015/0086114; U.S. Patent Application Publication No. 2015/0088522; U.S. Patent Application Publication No. 2015/0096872; U.S. Patent Application Publication No. 2015/0099557; U.S. Patent Application Publication No. 2015/0100196; U.S. Patent Application Publication No. 2015/0102109; U.S. Patent Application Publication No. 2015/0115035; U.S. Patent Application Publication No. 2015/0127791; U.S. Patent Application Publication No. 2015/0128116; U.S. Patent Application Publication No. 2015/0129659; U.S. Patent Application Publication No. 2015/0133047; U.S. Patent Application Publication No. 2015/0134470; U.S. Patent Application Publication No. 2015/0136851; U.S. Patent Application Publication No. 2015/0136854; U.S. Patent Application Publication No. 2015/0142492; U.S. Patent Application Publication No. 2015/0144692; U.S. Patent Application Publication No. 2015/0144698; U.S. Patent Application Publication No. 2015/0144701; U.S. Patent Application Publication No. 2015/0149946; U.S. Patent Application Publication No. 2015/0161429; U.S. Patent Application Publication No. 2015/0169925; U.S. Patent Application Publication No. 2015/0169929; U.S. Patent Application Publication No. 2015/0178523; U.S. Patent Application Publication No. 2015/0178534; U.S. Patent Application Publication No. 2015/0178535; U.S. Patent Application Publication No. 2015/0178536; U.S. Patent Application Publication No. 2015/0178537; U.S. Patent Application Publication No. 2015/0181093; U.S. Patent Application Publication No. 2015/0181109;

U.S. patent application Ser. No. 13/367,978 for a Laser Scanning Module Employing an Elastomeric U-Hinge Based Laser Scanning Assembly, filed Feb. 7, 2012 (Feng et al.);

U.S. patent application Ser. No. 29/458,405 for an Electronic Device, filed Jun. 19, 2013 (Fitch et al.);

U.S. patent application Ser. No. 29/459,620 for an Electronic Device Enclosure, filed Jul. 2, 2013 (London et al.);

U.S. patent application Ser. No. 29/468,118 for an Electronic Device Case, filed Sep. 26, 2013 (Oberpriller et al.);

U.S. patent application Ser. No. 14/150,393 for Indicia-reader Having Unitary Construction Scanner, filed Jan. 8, 2014 (Colavito et al.);

U.S. patent application Ser. No. 14/200,405 for Indicia Reader for Size-Limited Applications filed Mar. 7, 2014 (Feng et al.);

U.S. patent application Ser. No. 14/231,898 for Hand-Mounted Indicia-Reading Device with Finger Motion Triggering filed Apr. 1, 2014 (Van Horn et al.);

U.S. patent application Ser. No. 29/486,759 for an Imaging Terminal, filed Apr. 2, 2014 (Oberpriller et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/277,337 for MULTI-PURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/334,934 for a SYSTEM AND METHOD FOR INDICIA VERIFICATION, filed Jul. 18, 2014 (Hejl);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/446,391 for MULTI-FUNCTION POINT OF SALE APPARATUS WITH OPTICAL SIGNATURE CAPTURE filed Jul. 30, 2014 (Good et al.);

U.S. patent application Ser. No. 14/452,697 for INTERACTIVE INDICIA READER, filed Aug. 6, 2014 (Todeschini);

U.S. patent application Ser. No. 14/453,019 for DIMENSIONING SYSTEM WITH GUIDED ALIGNMENT, filed Aug. 6, 2014 (Li et al.);

U.S. patent application Ser. No. 14/462,801 for MOBILE COMPUTING DEVICE WITH DATA COGNITION SOFTWARE, filed on Aug. 19, 2014 (Todeschini et al.);

U.S. patent application Ser. No. 14/483,056 for VARIABLE DEPTH OF FIELD BARCODE SCANNER filed Sep. 10, 2014 (McCloskey et al.);

U.S. patent application Ser. No. 14/513,808 for IDENTIFYING INVENTORY ITEMS IN A STORAGE FACILITY filed Oct. 14, 2014 (Singel et al.);

U.S. patent application Ser. No. 14/519,195 for HANDHELD DIMENSIONING SYSTEM WITH FEEDBACK filed Oct. 21, 2014 (Laffargue et al.);

U.S. patent application Ser. No. 14/519,179 for DIMENSIONING SYSTEM WITH MULTIPATH INTERFERENCE MITIGATION filed Oct. 21, 2014 (Thuries et al.);

U.S. patent application Ser. No. 14/519,211 for SYSTEM AND METHOD FOR DIMENSIONING filed Oct. 21, 2014 (Ackley et al.);

U.S. patent application Ser. No. 14/519,233 for HANDHELD DIMENSIONER WITH DATA-QUALITY INDICATION filed Oct. 21, 2014 (Laffargue et al.);

U.S. patent application Ser. No. 14/519,249 for HANDHELD DIMENSIONING SYSTEM WITH MEASUREMENT-CONFORMANCE FEEDBACK filed Oct. 21, 2014 (Ackley et al.);

U.S. patent application Ser. No. 14/527,191 for METHOD AND SYSTEM FOR RECOGNIZING SPEECH USING WILDCARDS IN AN EXPECTED RESPONSE filed Oct. 29, 2014 (Braho et al.);

U.S. patent application Ser. No. 14/529,563 for ADAPTABLE INTERFACE FOR A MOBILE COMPUTING DEVICE filed Oct. 31, 2014 (Schoon et al.);

U.S. patent application Ser. No. 14/529,857 for BARCODE READER WITH SECURITY FEATURES filed Oct. 31, 2014 (Todeschini et al.);

U.S. patent application Ser. No. 14/398,542 for PORTABLE ELECTRONIC DEVICES HAVING A SEPARATE LOCATION TRIGGER UNIT FOR USE IN CONTROLLING AN APPLICATION UNIT filed Nov. 3, 2014 (Bian et al.);

U.S. patent application Ser. No. 14/531,154 for DIRECTING AN INSPECTOR THROUGH AN INSPECTION filed Nov. 3, 2014 (Miller et al.);

U.S. patent application Ser. No. 14/533,319 for BARCODE SCANNING SYSTEM USING WEARABLE DEVICE WITH EMBEDDED CAMERA filed Nov. 5, 2014 (Todeschini);

U.S. patent application Ser. No. 14/535,764 for CONCATENATED EXPECTED RESPONSES FOR SPEECH RECOGNITION filed Nov. 7, 2014 (Braho et al.);

U.S. patent application Ser. No. 14/568,305 for AUTO-CONTRAST VIEWFINDER FOR AN INDICIA READER filed Dec. 12, 2014 (Todeschini);

U.S. patent application Ser. No. 14/573,022 for DYNAMIC DIAGNOSTIC INDICATOR GENERATION filed Dec. 17, 2014 (Goldsmith);

U.S. patent application Ser. No. 14/578,627 for SAFETY SYSTEM AND METHOD filed Dec. 22, 2014 (Ackley et al.);

U.S. patent application Ser. No. 14/580,262 for MEDIA GATE FOR THERMAL TRANSFER PRINTERS filed Dec. 23, 2014 (Bowles);

U.S. patent application Ser. No. 14/590,024 for SHELVING AND PACKAGE LOCATING SYSTEMS FOR DELIVERY VEHICLES filed Jan. 6, 2015 (Payne);

U.S. patent application Ser. No. 14/596,757 for SYSTEM AND METHOD FOR DETECTING BARCODE PRINTING ERRORS filed Jan. 14, 2015 (Ackley);

U.S. patent application Ser. No. 14/416,147 for OPTICAL READING APPARATUS HAVING VARIABLE SETTINGS filed Jan. 21, 2015 (Chen et al.);

U.S. patent application Ser. No. 14/614,706 for DEVICE FOR SUPPORTING AN ELECTRONIC TOOL ON A USER'S HAND filed Feb. 5, 2015 (Oberpriller et al.);

U.S. patent application Ser. No. 14/614,796 for CARGO APPORTIONMENT TECHNIQUES filed Feb. 5, 2015 (Morton et al.);

U.S. patent application Ser. No. 29/516,892 for TABLE COMPUTER filed Feb. 6, 2015 (Bidwell et al.);

U.S. patent application Ser. No. 14/619,093 for METHODS FOR TRAINING A SPEECH RECOGNITION SYSTEM filed Feb. 11, 2015 (Pecorari);

U.S. patent application Ser. No. 14/628,708 for DEVICE, SYSTEM, AND METHOD FOR DETERMINING THE STATUS OF CHECKOUT LANES filed Feb. 23, 2015 (Todeschini);

U.S. patent application Ser. No. 14/630,841 for TERMINAL INCLUDING IMAGING ASSEMBLY filed Feb. 25, 2015 (Gomez et al.);

U.S. patent application Ser. No. 14/635,346 for SYSTEM AND METHOD FOR RELIABLE STORE-AND-FOR- WARD DATA HANDLING BY ENCODED INFORMATION READING TERMINALS filed Mar. 2, 2015 (Sevier);

U.S. patent application Ser. No. 29/519,017 for SCANNER filed Mar. 2, 2015 (Zhou et al.);

U.S. patent application Ser. No. 14/405,278 for DESIGN PATTERN FOR SECURE STORE filed Mar. 9, 2015 (Zhu et al.);

U.S. patent application Ser. No. 14/660,970 for DECODABLE INDICIA READING TERMINAL WITH COMBINED ILLUMINATION filed Mar. 18, 2015 (Kearney et al.);

U.S. patent application Ser. No. 14/661,013 for REPROGRAMMING SYSTEM AND METHOD FOR DEVICES INCLUDING PROGRAMMING SYMBOL filed Mar. 18, 2015 (Soule et al.);

U.S. patent application Ser. No. 14/662,922 for MULTIFUNCTION POINT OF SALE SYSTEM filed Mar. 19, 2015 (Van Horn et al.);

U.S. patent application Ser. No. 14/663,638 for VEHICLE MOUNT COMPUTER WITH CONFIGURABLE IGNITION SWITCH BEHAVIOR filed Mar. 20, 2015 (Davis et al.);

U.S. patent application Ser. No. 14/664,063 for METHOD AND APPLICATION FOR SCANNING A BARCODE WITH A SMART DEVICE WHILE CONTINUOUSLY RUNNING AND DISPLAYING AN APPLICATION ON THE SMART DEVICE DISPLAY filed Mar. 20, 2015 (Todeschini);

U.S. patent application Ser. No. 14/669,280 for TRANSFORMING COMPONENTS OF A WEB PAGE TO VOICE PROMPTS filed Mar. 26, 2015 (Funyak et al.);

U.S. patent application Ser. No. 14/674,329 for AIMER FOR BARCODE SCANNING filed Mar. 31, 2015 (Bidwell);

U.S. patent application Ser. No. 14/676,109 for INDICIA READER filed Apr. 1, 2015 (Huck);

U.S. patent application Ser. No. 14/676,327 for DEVICE MANAGEMENT PROXY FOR SECURE DEVICES filed Apr. 1, 2015 (Yeakley et al.);

U.S. patent application Ser. No. 14/676,898 for NAVIGATION SYSTEM CONFIGURED TO INTEGRATE MOTION SENSING DEVICE INPUTS filed Apr. 2, 2015 (Showering);

U.S. patent application Ser. No. 14/679,275 for DIMENSIONING SYSTEM CALIBRATION SYSTEMS AND METHODS filed Apr. 6, 2015 (Laffargue et al.);

U.S. patent application Ser. No. 29/523,098 for HANDLE FOR A TABLET COMPUTER filed Apr. 7, 2015 (Bidwell et al.);

U.S. patent application Ser. No. 14/682,615 for SYSTEM AND METHOD FOR POWER MANAGEMENT OF MOBILE DEVICES filed Apr. 9, 2015 (Murawski et al.);

U.S. patent application Ser. No. 14/686,822 for MULTIPLE PLATFORM SUPPORT SYSTEM AND METHOD filed Apr. 15, 2015 (Qu et al.);

U.S. patent application Ser. No. 14/687,289 for SYSTEM FOR COMMUNICATION VIA A PERIPHERAL HUB filed Apr. 15, 2015 (Kohtz et al.);

U.S. patent application Ser. No. 29/524,186 for SCANNER filed Apr. 17, 2015 (Zhou et al.);

U.S. patent application Ser. No. 14/695,364 for MEDICATION MANAGEMENT SYSTEM filed Apr. 24, 2015 (Sewell et al.);

U.S. patent application Ser. No. 14/695,923 for SECURE UNATTENDED NETWORK AUTHENTICATION filed Apr. 24, 2015 (Kubler et al.);

U.S. patent application Ser. No. 29/525,068 for TABLET COMPUTER WITH REMOVABLE SCANNING DEVICE filed Apr. 27, 2015 (Schulte et al.);

U.S. patent application Ser. No. 14/699,436 for SYMBOL READING SYSTEM HAVING PREDICTIVE DIAGNOSTICS filed Apr. 29, 2015 (Nahill et al.);

U.S. patent application Ser. No. 14/702,110 for SYSTEM AND METHOD FOR REGULATING BARCODE DATA INJECTION INTO A RUNNING APPLICATION ON A SMART DEVICE filed May 1, 2015 (Todeschini et al.);

U.S. patent application Ser. No. 14/702,979 for TRACKING BATTERY CONDITIONS filed May 4, 2015 (Young et al.);

U.S. patent application Ser. No. 14/704,050 for INTERMEDIATE LINEAR POSITIONING filed May 5, 2015 (Charpentier et al.);

U.S. patent application Ser. No. 14/705,012 for HANDS-FREE HUMAN MACHINE INTERFACE RESPONSIVE TO A DRIVER OF A VEHICLE filed May 6, 2015 (Fitch et al.);

U.S. patent application Ser. No. 14/705,407 for METHOD AND SYSTEM TO PROTECT SOFTWARE-BASED NETWORK-CONNECTED DEVICES FROM ADVANCED PERSISTENT THREAT filed May 6, 2015 (Hussey et al.);

U.S. patent application Ser. No. 14/707,037 for SYSTEM AND METHOD FOR DISPLAY OF INFORMATION USING A VEHICLE-MOUNT COMPUTER filed May 8, 2015 (Chamberlin);

U.S. patent application Ser. No. 14/707,123 for APPLICATION INDEPENDENT DEX/UCS INTERFACE filed May 8, 2015 (Pape);

U.S. patent application Ser. No. 14/707,492 for METHOD AND APPARATUS FOR READING OPTICAL INDICIA USING A PLURALITY OF DATA SOURCES filed May 8, 2015 (Smith et al.);

U.S. patent application Ser. No. 14/710,666 for PRE-PAID USAGE SYSTEM FOR ENCODED INFORMATION READING TERMINALS filed May 13, 2015 (Smith);

U.S. patent application Ser. No. 29/526,918 for CHARGING BASE filed May 14, 2015 (Fitch et al.);

U.S. patent application Ser. No. 14/715,672 for AUGUMENTED REALITY ENABLED HAZARD DISPLAY filed May 19, 2015 (Venkatesha et al.);

U.S. patent application Ser. No. 14/715,916 for EVALUATING IMAGE VALUES filed May 19, 2015 (Ackley);

U.S. patent application Ser. No. 14/722,608 for INTERACTIVE USER INTERFACE FOR CAPTURING A DOCUMENT IN AN IMAGE SIGNAL filed May 27, 2015 (Showering et al.);

U.S. patent application Ser. No. 29/528,165 for IN-COUNTER BARCODE SCANNER filed May 27, 2015 (Oberpriller et al.);

U.S. patent application Ser. No. 14/724,134 for ELECTRONIC DEVICE WITH WIRELESS PATH SELECTION CAPABILITY filed May 28, 2015 (Wang et al.);

U.S. patent application Ser. No. 14/724,849 for METHOD OF PROGRAMMING THE DEFAULT CABLE INTERFACE SOFTWARE IN AN INDICIA READING DEVICE filed May 29, 2015 (Barten);

U.S. patent application Ser. No. 14/724,908 for IMAGING APPARATUS HAVING IMAGING ASSEMBLY filed May 29, 2015 (Barber et al.);

U.S. patent application Ser. No. 14/725,352 for APPARATUS AND METHODS FOR MONITORING ONE OR MORE PORTABLE DATA TERMINALS (Caballero et al.);

U.S. patent application Ser. No. 29/528,590 for ELECTRONIC DEVICE filed May 29, 2015 (Fitch et al.);

U.S. patent application Ser. No. 29/528,890 for MOBILE COMPUTER HOUSING filed Jun. 2, 2015 (Fitch et al.);

U.S. patent application Ser. No. 14/728,397 for DEVICE MANAGEMENT USING VIRTUAL INTERFACES CROSS-REFERENCE TO RELATED APPLICATIONS filed Jun. 2, 2015 (Caballero);

U.S. patent application Ser. No. 14/732,870 for DATA COLLECTION MODULE AND SYSTEM filed Jun. 8, 2015 (Powilleit);

U.S. patent application Ser. No. 29/529,441 for INDICIA READING DEVICE filed Jun. 8, 2015 (Zhou et al.);

U.S. patent application Ser. No. 14/735,717 for INDICIA-READING SYSTEMS HAVING AN INTERFACE WITH A USER'S NERVOUS SYSTEM filed Jun. 10, 2015 (Todeschini);

U.S. patent application Ser. No. 14/738,038 for METHOD OF AND SYSTEM FOR DETECTING OBJECT WEIGHING INTERFERENCES filed Jun. 12, 2015 (Amundsen et al.);

U.S. patent application Ser. No. 14/740,320 for TACTILE SWITCH FOR A MOBILE ELECTRONIC DEVICE filed Jun. 16, 2015 (Bandringa);

U.S. patent application Ser. No. 14/740,373 for CALIBRATING A VOLUME DIMENSIONER filed Jun. 16, 2015 (Ackley et al.);

U.S. patent application Ser. No. 14/742,818 for INDICIA READING SYSTEM EMPLOYING DIGITAL GAIN CONTROL filed Jun. 18, 2015 (Xian et al.);

U.S. patent application Ser. No. 14/743,257 for WIRELESS MESH POINT PORTABLE DATA TERMINAL filed Jun. 18, 2015 (Wang et al.);

U.S. patent application Ser. No. 29/530,600 for CYCLONE filed Jun. 18, 2015 (Vargo et al);

U.S. patent application Ser. No. 14/744,633 for IMAGING APPARATUS COMPRISING IMAGE SENSOR ARRAY HAVING SHARED GLOBAL SHUTTER CIRCUITRY filed Jun. 19, 2015 (Wang);

U.S. patent application Ser. No. 14/744,836 for CLOUD-BASED SYSTEM FOR READING OF DECODABLE INDICIA filed Jun. 19, 2015 (Todeschini et al.);

U.S. patent application Ser. No. 14/745,006 for SELECTIVE OUTPUT OF DECODED MESSAGE DATA filed Jun. 19, 2015 (Todeschini et al.);

U.S. patent application Ser. No. 14/747,197 for OPTICAL PATTERN PROJECTOR filed Jun. 23, 2015 (Thuries et al.);

U.S. patent application Ser. No. 14/747,490 for DUAL-PROJECTOR THREE-DIMENSIONAL SCANNER filed Jun. 23, 2015 (Jovanovski et al.); and U.S. patent application Ser. No. 14/748,446 for CORDLESS INDICIA READER WITH A MULTIFUNCTION COIL FOR WIRELESS CHARGING AND EAS DEACTIVATION, filed Jun. 24, 2015 (Xie et al.).

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A printer for printing media comprising:

a rotatable ribbon supply spindle;

a rotatable take-up ribbon spindle;

at least one sensor that outputs ribbon width and diameter of a ribbon loaded on the rotatable ribbon supply spindle;

a sensor which outputs ribbon diameter on the ribbon loaded on the rotatable take-up ribbon spindle;

a drive system configured to rotate the rotatable take-up ribbon spindle, the drive system further providing rotation to the rotatable ribbon supply via tension on the ribbon loaded on the rotatable ribbon supply spindle and taken-up on the rotatable take-up ribbon spindle;

firmware, the firmware being communicatively linked to the at least one sensor for determining ribbon width and diameter of the ribbon loaded on the rotatable ribbon supply spindle, to the sensor for determining ribbon diameter on the ribbon loaded on the rotatable take-up ribbon spindle, and to the drive system;

the firmware being configured to calculate ribbon tension at the ribbon supply spindle from the output of the at least one sensor on the rotatable ribbon supply spindle;

the firmware being further configured to calculate the torque on the ribbon on the rotatable ribbon take-up spindle required to match the ribbon tension at the take-up spindle to the ribbon tension at the rotatable ribbon supply spindle based upon the calculated total tension at the rotatable ribbon supply spindle and the output from the sensor on the ribbon take-up spindle; and the firmware being configured to adjust the drive system so that the torque at the rotatable take-up spindle is the calculated torque required to match the ribbon tension at the rotatable ribbon take-up spindle to the ribbon tension at the rotatable ribbon supply spindle.

2. The printer of claim 1, wherein the at least one sensor that outputs ribbon width and diameter of a ribbon loaded on the rotatable ribbon supply spindle is comprised of an encoder sensor that outputs the diameter of the ribbon loaded on the rotatable ribbon supply spindle, the encoder sensor being disposed on a base of the rotatable ribbon supply spindle; and a second sensor that outputs the width of the ribbon loaded on the rotatable ribbon supply spindle, the second sensor being disposed on the rotatable ribbon supply spindle.

3. The printer of claim 1, wherein the ribbon width is proportional to the torque at the rotatable ribbon supply spindle.

4. The printer of claim 2, wherein the encoder sensor rotates with the rotatable supply spindle; the encoder sensor rotation rate being proportional to the radius of the ribbon loaded on the rotatable ribbon supply spindle; and the encoder sensor on the ribbon supply spindle being configured to determine the rotation rate based upon a number of encoder interrupts for a given period.

5. The printer of claim 1, wherein the sensor which outputs ribbon diameter on the ribbon loaded on the rotatable take-up ribbon spindle is an encoder sensor that rotates with the rotatable ribbon take-up spindle; the encoder sensor at the rotatable ribbon take-up spindle has a rotation rate proportional to the ribbon radius at the rotatable ribbon take-up spindle; the encoder sensor at the rotatable ribbon take-up spindle being configured determine the rotation rate based upon a number of encoder interrupts for a given period.

6. The printer of claim 1, wherein the firmware calculation for ribbon tension at the rotatable ribbon supply spindle is SRT/SRR, where SRT is the torque at the supply ribbon spindle, and SRR is the supply ribbon radius.

7. The printer of claim 6, wherein the firmware calculation of torque on the ribbon on the rotatable ribbon take-up spindle required to match the ribbon tension at the take-up spindle to the ribbon tension at the rotatable ribbon supply spindle is (SRT/SRR)*TRR, where TRR is the radius of the ribbon at the rotatable ribbon take-up spindle.

8. The printer of claim 1, wherein the drive system is an electronic motor; and wherein the firmware is configured to adjust current to the motor so that the torque at the rotatable take-up spindle is the calculated torque required to match the ribbon tension at the rotatable ribbon take-up spindle to the ribbon tension at the rotatable ribbon supply spindle.

9. The printer of claim 1, further comprising spring wraps on the rotatable ribbon supply spindle, the spring wraps providing torque to the ribbon on the rotatable ribbon supply spindle.

10. The printer of claim 1, wherein the firmware is configured to periodically adjust the drive system based upon periodic calculations of the torque on the ribbon on the rotatable ribbon take-up spindle required to match the ribbon tension at the take-up spindle to the ribbon tension at the rotatable ribbon supply spindle based upon the calculated total tension at the rotatable ribbon supply spindle and the output from the sensor on the ribbon take-up spindle.

11. A printer comprising:

a rotatable ribbon supply spindle;

an encoder sensor for determining the diameter of a ribbon loaded on the ribbon supply spindle;

a sensor for determining width of the ribbon loaded on the ribbon supply spindle;

a rotatable ribbon take-up spindle for taking up the ribbon;

an encoder sensor on the ribbon take-up spindle for determining the diameter of the ribbon on the take-up spindle;

a drive system configured to rotate the ribbon take-up spindle, the drive system being powered by an electric power supply, the drive system further providing rotation to the rotatable ribbon supply spindle via tension on a ribbon loaded on the rotatable ribbon supply spindle and taken-upon the rotatable take-up ribbon spindle;

firmware, the firmware being communicatively linked to receive sensor outputs from the encoder sensor on the ribbon supply spindle, the sensor for determining ribbon width, and the encoder sensor on the ribbon take-up spindle;

the firmware being configured to determine torque in the ribbon at the supply spindle based upon the output from the sensor for determining width of the ribbon on the ribbon supply spindle;

the firmware being configured to calculate the total tension in the ribbon supply based upon the torque determined at in the ribbon at the supply spindle and based upon the output from the encoder sensor on the ribbon supply spindle, the firmware calculation being SRT/SRR, where SRT is Supply Ribbon Torque and SRR is Supply Ribbon Radius;

the firmware being further configured to calculate the torque in the rotatable ribbon take-up spindle required to match the ribbon tension in the take-up spindle to the ribbon tension in the supply spindle based upon the calculated total tension in the ribbon supply and the output from the encoder sensor on the ribbon take-up spindle, the firmware calculation being (SRT/SRR) *TRR, where TRR is the radius of the ribbon at the take-up spindle;

the firmware being communicatively linked to the electric power supply and configured to control current supplied to the drive system, the current being proportional to a rate of rotation of the drive system and the take-up spindle; and the firmware being configured to adjust the current supplied to the drive system so that the torque at the take-up spindle is the calculated torque required to match the ribbon tension in the take-up spindle to the ribbon tension in the supply spindle.

12. The printer of claim 11, further comprising spring wraps on the rotatable ribbon supply spindle, the spring wraps securing the ribbon on the rotatable ribbon supply spindle.

13. The printer of claim 12, wherein the ribbon width is proportional to the torque at the rotatable ribbon supply spindle.

14. The printer of claim 11, wherein the rotatable ribbon supply spindle is comprised of:

multiple segments, the first segment of the multiple segments being adjacent to a base, each subsequent segment of the multiple segments being adjacent to the previous segment of the multiple segments;

the sensor for determining ribbon width is comprised of:

a commutator, the commutator being disposed circumferentially on the first segment of the spindle;

at least two brushes, the brushes being connected to a voltage source, disposed generally on either side of the commutator, and in electrical contact with the commutator, wherein the voltage source, the brushes, and the commutator form a closed electrical circuit;

a c-shaped conductive spring disposed on each of the multiple segments;

wherein the c-shaped conductive spring has two ends and a center portion;

wherein the c-shaped conductive springs are in an uncompressed state in the absence of a printer ribbon over the one or more c-shaped conductive springs;

wherein the c-shaped conductive springs are in a compressed state in the presence of a printer ribbon positioned over the one or more c-shaped conductive springs;

wherein the c-shaped conductive spring on each segment of the multiple segments has a length such that when the c-shaped conductive spring is in the compressed state, the two ends of the c-shaped conductive spring make electrical contact with the commutator or the c-shaped conductive spring of a previous segment completing an additional electrical circuit in parallel with the closed electrical circuit;

a resistor, the resister is disposed proximate to the center portions of each of the c-shaped conductive springs and in electrical contact with the center portion of the c-shaped conductive springs; and a resistance meter, the resistance meter connected to the closed electrical circuit, such that the reading on the meter indicates how many additional parallel circuits are completed, the number of additional parallel circuits completed indicating the approximate ribbon width.

15. The printer of claim 14, wherein the encoder sensor on the rotatable ribbon supply spindle is disposed on the base of the rotatable ribbon supply spindle and rotates with the rotatable ribbon supply spindle, the encoder sensor rotation rate being proportional to the ribbon radius; and the encoder sensor on the ribbon supply spindle being configured to determine the rotation rate based upon a number of encoder interrupts for a given period.

16. The printer of claim 11, wherein the encoder sensor on the ribbon take-up spindle has a rotation rate proportional to the ribbon radius; and the encoder sensor on the ribbon take-up spindle being configured to determine the rotation rate based upon a number of encoder interrupts for a given period.

17. A method of controlling ribbon tension on a printer, the printer having a rotatable ribbon supply spindle, a rotatable ribbon take-up spindle, and a motor driving the ribbon take-up spindle, comprising the steps of:

i. sensing the diameter of the ribbon on the ribbon supply spindle;

ii. sensing the ribbon width on the ribbon supply spindle;

iii. calculating tension on the ribbon at the ribbon supply spindle, the tension based upon the first and second sensing steps;

iv. sensing the ribbon diameter of the ribbon at ribbon take-up spindle;

v. calculating the torque required to match tensions between the ribbon supply and the ribbon take-up based upon the first calculating step and the third sensing step; and vi. adjusting the motor driving the ribbon take-up spindle to supply the required torque found in the second calculating step.

18. The method of 17, wherein the first calculating step is accomplished with firmware, wherein the first calculating step is comprised of the steps of:

receiving information about the diameter of the ribbon on the ribbon supply spindle from the first sensing step;

receiving information about the width of the ribbon on the ribbon supply spindle from the second sensing step;

converting the information about the width of the ribbon into a torque; and dividing the torque by the ribbon radius derived from the information about diameter or the ribbon to obtain a supply ribbon tension.

19. The method of claim 18, wherein the second calculating step is accomplished with the firmware, wherein the second calculating step is comprised of the steps of:

receiving information about the diameter of the ribbon on the take-up spindle from the third sensing step; and multiplying the ribbon radius on the take-up spindle by the supply ribbon tension.

20. The method of claim 19, wherein the adjusting step is accomplished with the firmware, the firmware being configured to control current supplied to the motor.

* * * * *